US005189969A

United States Patent [19]

Ito et al.

[11] Patent Number: 5,189,969

[45] Date of Patent: Mar. 2, 1993

[54] DEVICE FOR PROCESSING SHEET MATERIAL WITH COLORED PATTERN

[75] Inventors: Hirosumi Ito, Nagoya; Etsuzo Nomura, Kasugai; Kohichi Akahane, Komaki; Hirokazu Takeuchi, Chita, all of Japan

[73] Assignee: Brother Kogyo Kabushiki Kaisha, Nagoya, Japan

[21] Appl. No.: 832,397

[22] Filed: Feb. 7, 1992

[30] Foreign Application Priority Data

Feb. 12, 1991 [JP] Japan ..... 3-19053

[51] Int. Cl.[5] ..... D05B 19/00; D05B 27/06; D05B 27/08

[52] U.S. Cl. ..... 112/121.11; 112/306; 112/314; 112/320; 226/32; 356/425

[58] Field of Search ..... 112/314, 306, 320, 315, 112/121.11, 121.12, 153; 250/559, 226, 548, 561, 571; 356/425, 429, 419, 402, 416; 271/226; 226/32

[56] References Cited

U.S. PATENT DOCUMENTS 4,898,110 2/1990 Nomura et al. ..... 112/314
4,901,659 2/1990 Nomura et al. ..... 112/314
4,982,677 1/1991 Nomura et al. ..... 112/314
5,082,529 1/1992 Burk ..... 356/425 X

FOREIGN PATENT DOCUMENTS 60-153896 8/1985 Japan .

*Primary Examiner*—Peter Nerbun
*Attorney, Agent, or Firm*—Oliff & Berridge

[57] ABSTRACT

A processing device for processing a sheet material with a pattern of the present invention is such as a sewing machine with pattern matching operation. The processing device has a detecting unit for detecting a color state of the pattern of the sheet material and producing a color state signal indicative of the color state. The processing device processes the sheet material on the basis of the color state signal produced by said detecting means. According to the present invention, the processing device is provided with an automatic adjusting unit for adjusting the detecting unit to allow the detecting unit to produce a desired color state signal with respect to a reference color state. Therefore, the white balance or the dynamic range is properly adjusted simply and reliably for the processing device.

22 Claims, 23 Drawing Sheets

DEVICE FOR PROCESSING SHEET MATERIAL WITH COLORED PATTERN

BACKGROUND OF THE INVENTION

A present invention relates to a device for processing sheet material with a colored pattern, based on information of the colored pattern detected from the sheet material.

Heretofore, devices for processing sheet materials with colored patterns have been well known as sewing machines with a pattern matching function (pattern matching sewing machines) which have color sensors.

Many pattern matching sewing machines are known as disclosed in Japanese Laid-Open Patent Publication No. 60-153896, for example. Generally, the known pattern matching sewing machine is provided with color sensors. The pattern matching sewing machine operates to detect, with the color sensors, colored patterns of two fabrics before they are sewn to thereby produce three primary color component signals of red (R), green (G), and blue (B) for the colored patterns of both the two fabrics, calculates a shift (mismatch) amount between the patterns of the two fabrics based on the obtained three primary color component signals for the two fabrics, and adjusting relative feed rates of the fabrics until the patterns of the fabrics match each other.

In order to determine a slight shift amount of the patterns based on the color component signals from the color sensors and attain a highly accurate pattern matching operation, it is necessary that the levels of the three primary color component signals of red (R), green (G), and blue (B) be properly balanced with one another. For example, the three primary color component signals obtained for white color should have their levels equal to one another. In other words, a so-called white balance should be properly adjusted for the color sensors provided in the pattern matching sewing machine.

However, there may occur a problem that the white balance of the color sensors fails to be properly adjusted, due to manufacturing tolerances of the color sensors or aging or environments of use of the sewing machine.

SUMMARY OF THE INVENTION

In order to properly adjust the white balance of the color sensors employed in the pattern matching sewing machine, it may be proposed that the following white balance adjusting operation should be performed before the sewing machine is to be shipped out of its manufacturing factory or when a user operates the delivered sewing machine:

That is, an operator (or user) places a white board in a position detectable by the color sensors. While the levels of the color component signals produced by the color sensors are being indicated or monitored by monitoring means such as meters or output indicator lamps, the operator manually operates switches of variable resistors provided in the sewing machine for adjusting the levels of the color component signals produced by the color sensors, until when the levels of all the color component signals become a reference level predetermined for the white color.

However, such a manual adjusting process may not be smoothly performed by an unskilled operator. This problem will become particularly serious when the user adjusts the color sensors of the delivered pattern matching sewing machine.

Furthermore, the white balance adjusting operation has to be conducted six times, in order to adjust all the levels of the three primary color component signals for the respective two fabrics. Since the adjusting process is manually effected, therefore, the white balance adjusting operation will be highly time-consuming.

Since the switches of the variable resistors are provided on the sewing machine, there may further occur a problem that the operator may erroneously operate them and the white balance adjustment which have been achieved are made no longer effective.

In view of the above, it is an object of the present invention to provide a device for processing sheet material with a colored pattern which is capable of simply and reliably attaining color state adjustment. In this description, the word "color (color state) of a pattern" is directed to a color state defined by either one or ones of lightness, saturation, hue and other color state defining factors.

To achieve the above object, there is provided in accordance with the present invention a processing device for processing sheet material with a pattern, comprising: detecting means for detecting a color state of the pattern of the sheet material and producing a color state signal indicative of the color state; adjusting means for adjusting said detecting means to allow the detecting means to produce a desired color state signal with respect to a reference color state; and processing means for processing the sheet material on the basis of the color state signal produced by the detecting means.

The detecting means may include: color detecting means for detecting the color state of the sheet material pattern and producing a color signal corresponding to the color state; and conversion means for converting, with a conversion manner, the color signal into the color state signal indicative of the color state of the sheet material pattern. The adjusting means adjusts the conversion manner of the conversion means to allow the conversion means to produce the desired color state signal with respect to the reference color state.

The adjusting means may include: control means for controlling the color detecting means to detect the reference color state and produce a reference color signal; and conversion manner adjusting means for adjusting, in response to the produced reference color signal, the conversion manner of the conversion means to allow the conversion means to produce the desired color state signal with respect to the reference color state.

Other objects, features and advantages of the present invention will become apparent in the following specification and accompanying drawings.

BRIEF DESCRIPTION OF THE DRAWINGS

Throughout the accompanying drawings, the same reference numerals or characters are used to refer to the same or like parts.

DETAILED DESCRIPTION OF THE PREFERRED EMBODIMENTS

A pattern matching sewing machine of a first preferred embodiment to which applied is a device for processing sheet material of the present invention will be described below, with reference to FIGS. 1 through 14.

FIGS. 1 through 5 schematically show a pattern matching sewing machine according to the embodiment. The pattern matching sewing machine 1 is controlled by an electronic controller 160 shown in FIG. 3. The mechanical structure of the pattern matching sewing machine 1 will first be described below.

Figure 4:
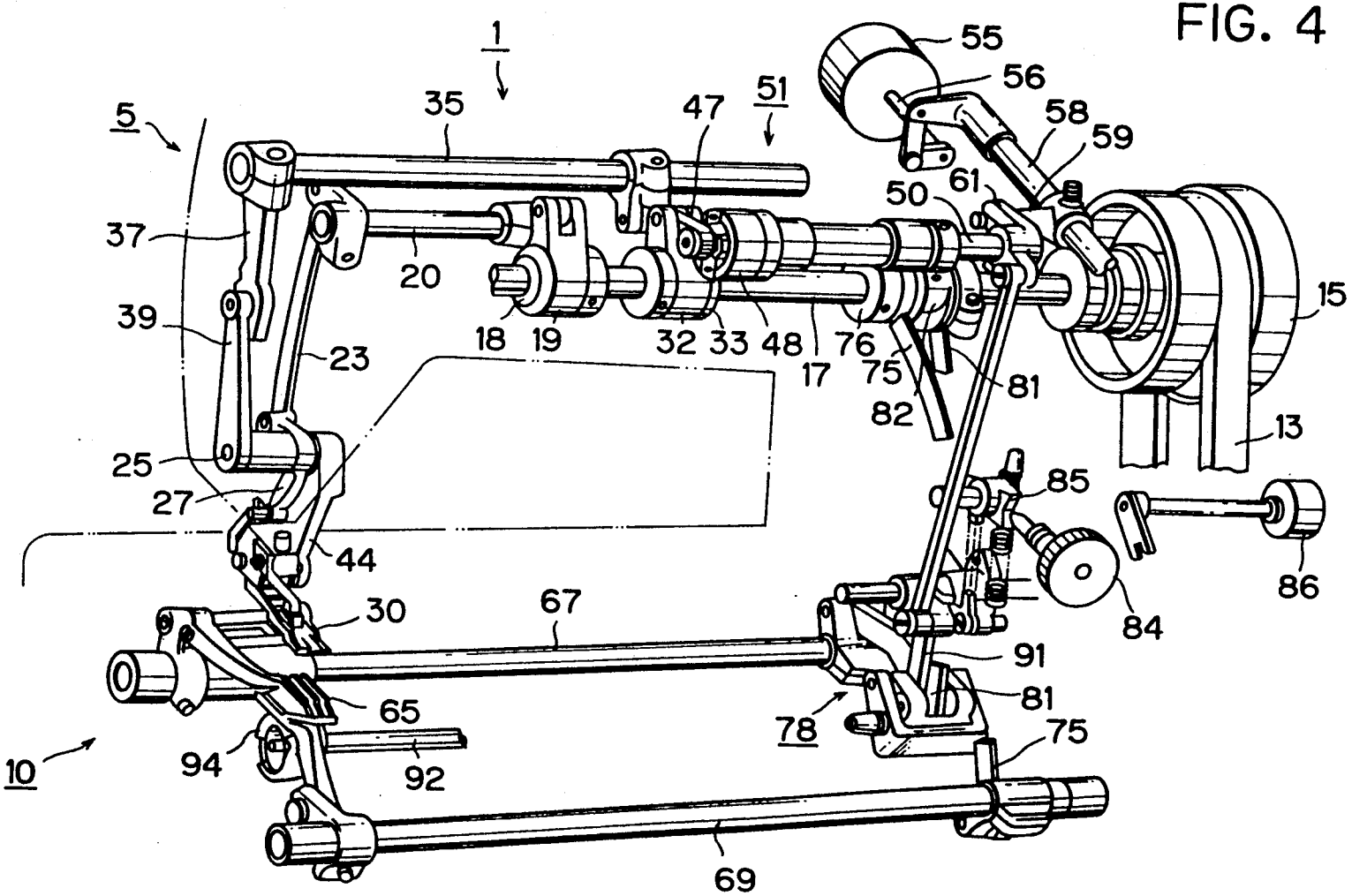
FIG. 4 is a perspective view schematically showing a structure of the sewing machine of the invention.

As shown in FIG. 4, the pattern matching sewing machine 1 generally includes an arm 5 and a bed 10. The arm 5 houses therein a main shaft 17 to which rotative power is transmitted from a sewing machine motor 190 (not shown in FIG. 4) through a belt 13 and a pulley 15. Over the main shaft 17, there is fitted an eccentric cam 18 that is operatively coupled to an actuator shaft 20 through a crank rod 19. When the main shaft 17 rotates about its own axis, the actuator shaft 20 angularly moves about its own axis through a predetermined angle in synchronism with the rotation of the main shaft 17, to thereby move a coupling link 23 vertically. An arm 27 is coupled to the coupling link 23 so as to swing about a support shaft 25. The arm 27 swings to move vertically an upper feed dog 30. Another actuator shaft 35 is operatively coupled to the main shaft 17 through a crank rod 32, an eccentric cam 33, and a link 47. In response to rotation of the main shaft 17, the actuator shaft 35 angularly moves about its own axis through a predetermined angle to swing coupling levers 37 and 39 rearwardly and forwardly. To the coupling lever 39, there is coupled an arm 44 that is swingable about the support shaft 25. Upon swinging movement of the arm 44, the upper feed dog 30 moves rearwardly and forwardly. Therefore, the upper feed dog 30 effects four motions, i.e., upward movement to forward movement to downward movement to rearward movement, in response to the angular movements of both the actuator shafts 20 and 35 in synchronism with the rotation of the main shaft 17.

The rate (i.e., an upper feed rate) at which the upper feed dog 30 moves rearwardly and forwardly is determined by the angular shift amount through which the actuator shaft 35 angularly moves. The link 47 which is coupled to the actuator shaft 35 is connected to an upper feed rate adjusting member 48 fitted over one end of an angularly movable shaft 50. The upper feed rate adjusting member 48 serves to change the inclination of the link 47 to vary the angular shift amount of the actuator shaft 35. The crank rod 32, the eccentric cam 33, the link 47, the upper feed rate adjusting member 48, and the angularly movable shaft 50 jointly constitute an upper feed rate adjuster 51. A turn lever 61 is connected to the other end of the angularly movable shaft 50. The turn lever 61 is composed of two arms extending away from the angularly movable shaft 50. One of the arms of the turn lever 61 is held in abutment against an engaging member 59 attached to a drive shaft 58. The drive shaft 58 is coupled to an output shaft 56 of a step motor 55. Therefore, according to the rotation of the step motor 55, the engaging member 59 and the turn lever 61 cooperate with each other to regulate the angle through which the angularly movable shaft 50 angularly moves, thus adjusting the angular shift amount of the actuator shaft 35 to adjust the upper feed rate.

The bed 10 houses therein a horizontal feed shaft 67 and a vertical feed shaft 69 which serve to cooperate with each other to effect four motions of a lower feed dog 65, i.e., upward movement to forward movement to downward movement to rearward movement. The vertical feed shaft 69 is operatively coupled to an eccentric cam 76 fitted over the main shaft 17 through a crank rod 75. In response to rotation of the main shaft 17, the vertical feed shaft 69 is angularly moved about its own axis through a predetermined angle to impart vertical movement to the lower feed dog 65. The horizontal feed shaft 67 is operatively coupled to an eccentric cam 82 fitted over the main shaft 17 through a lower feed rate adjuster 78 and a crank rod 81. In response to rotation of the main shaft 17, the horizontal feed shaft 67 is angularly moved about its own axis through a predetermined angle to move the lower feed dog 65 rearwardly and forwardly. The lower feed rate adjuster 78 serves to convert longitudinal movement of the crank rod 81 depending on rotation of the main shaft 17 into swinging movement of the horizontal feed shaft 67, and is arranged to vary the angular shift amount through which the horizontal feed shaft 67 angularly moves. A manual feed rate adjusting member 84 is disposed outside of a sewing machine frame. The manual feed rate adjusting member 84 has a distal end held against the bottom of a V-shaped groove of a feed rate setting unit 85. When the manual feed rate adjusting member 84 is turned to vary its axial position, the inclination of the feed rate setting unit 85 is adjusted. The feed rate setting unit 85 is operatively coupled to the lower feed rate adjuster 78 through a link 91. Therefore, when the inclination of the feed rate setting unit 85 is varied, the feed rate is adjusted by the lower feed rate adjuster 78. Therefore, the lower feed rate can be varied when the manual feed rate adjusting member 84 is turned. The feed rate setting unit 85 is operatively associated with a potentiometer 86 which outputs a signal indicative of the lower feed rate.

Figure 5:
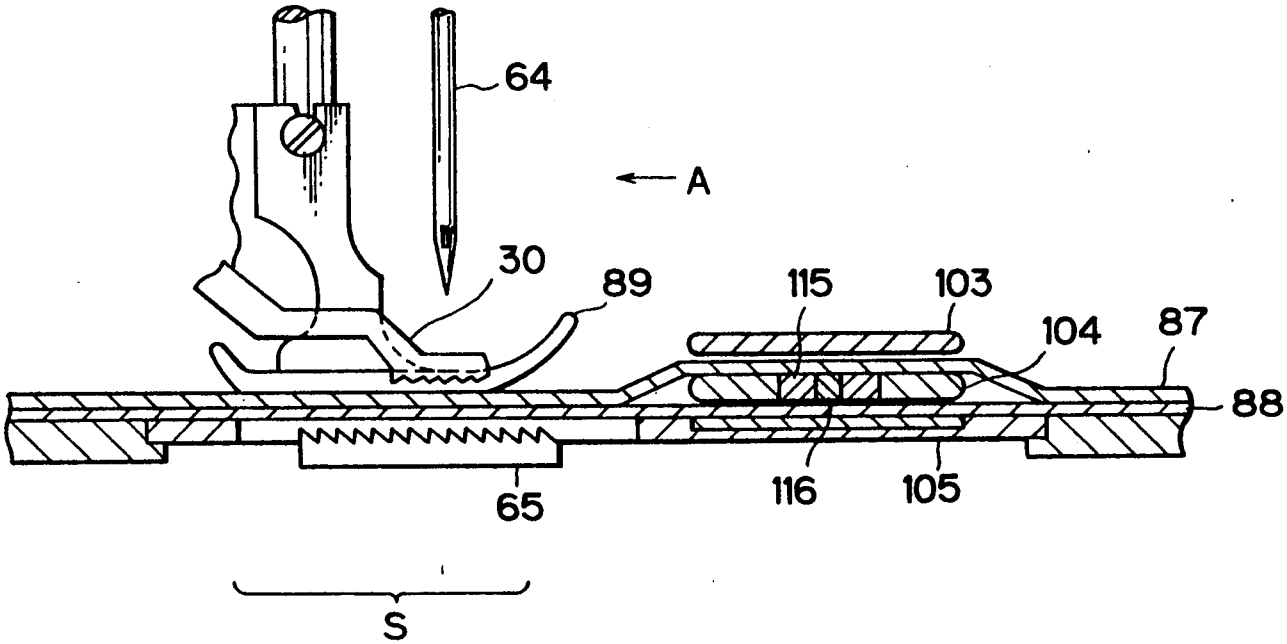
FIG. 5 is a fragmentary cross-sectional view illustrative of a stitch forming region S of the sewing machine of the first embodiment.

As shown in FIG. 5, a sewing needle 64 is mounted on the distal end of a needle bar (not shown in the drawing) which is operatively coupled to the main shaft 17 so as to be driven vertically. Within the bed 10 below the sewing needle 64, there is disposed a loop catcher 94 attached to a lower shaft 92 rotatable synchronously with the main shaft 17, as shown in FIG. 4. The sewing needle 64 and the loop catcher 94 jointly serve as a stitch forming means as a sewing means.

The upper feed dog 30 and the lower feed dog 65 each makes the four motions in synchronism with the rotation of the main shaft 17 in a stitch forming region S shown in FIG. 5. In the stitch forming region S, two fabrics 87 and 88 which are supplied under a presser foot 89 are fed by the upper and lower feed dogs 30 and 65, and stitches are formed on the fabrics 87 and 88 by the sewing needle 64 and the loop catcher 94.

Figure 1:
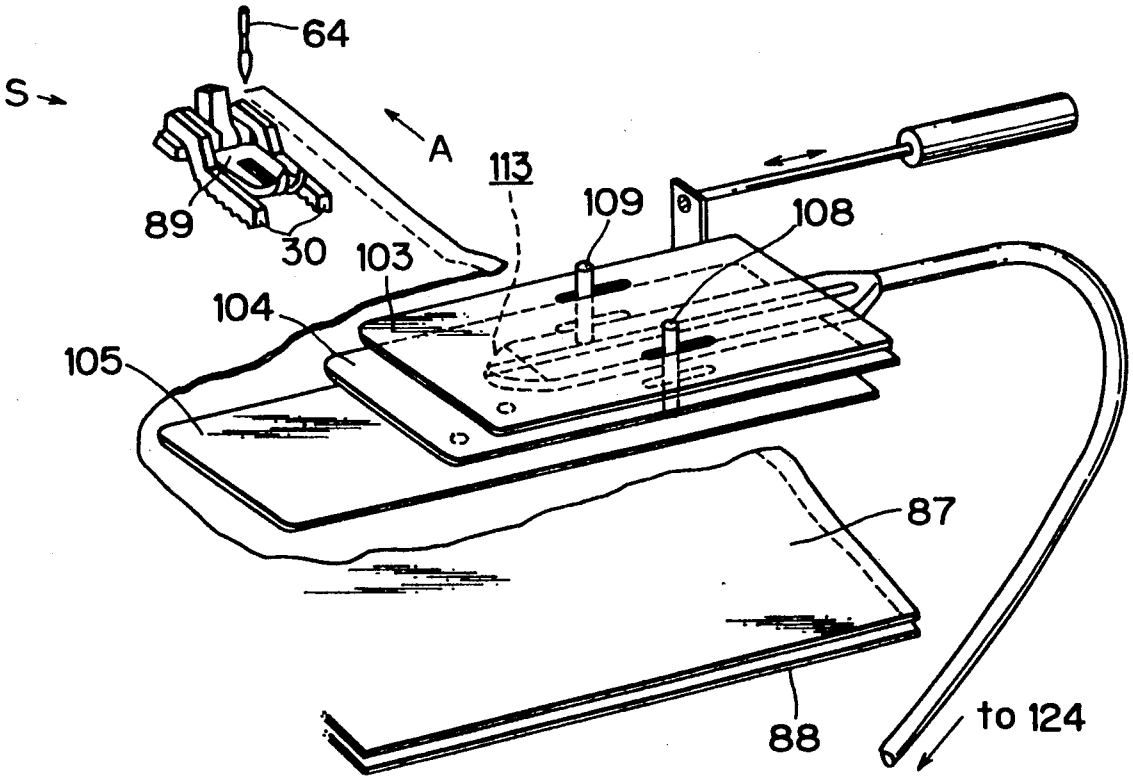
FIG. 1 is a perspective view of a pattern detecting portion of a pattern matching sewing machine according to a first embodiment of the present invention.

As shown in FIGS. 1 and 5, three fabric guide plates 103, 104 and 105 are disposed in three layers in front of the stitch forming region S in the direction (indicated by the arrow A) in which the fabrics are fed. The fabric guide plate 105 is provided with vertical pins 108 and 109 extending through slots defined in the fabric guide plates 103 and 104. The pins 108 and 109 serves as means for abutting against edges of the two fabrics 87 and 88 to prevent the fabrics 87 and 88 from being shifted laterally across the direction in which the fabrics are fed. The guide plates 103 through 105 are arranged such that relative movement of them can be performed along the pins 108 and 109 in the vertical direction. More specifically to say, the upper and middle fabric guide plates 103 and 104 can be relatively moved toward each other (or closed) so as to tightly sandwich therebetween the upper fabric 87 while preventing extraneous light from entering a detector 113 fitted to the guide plate 104 which will be described below. The middle and lower fabric guide plates 104 and 105 can be relatively moved toward each other (or closed) so as to tightly sandwich therebetween the lower fabric 88 while preventing extraneous light from entering the detector 113.

Figure 6:
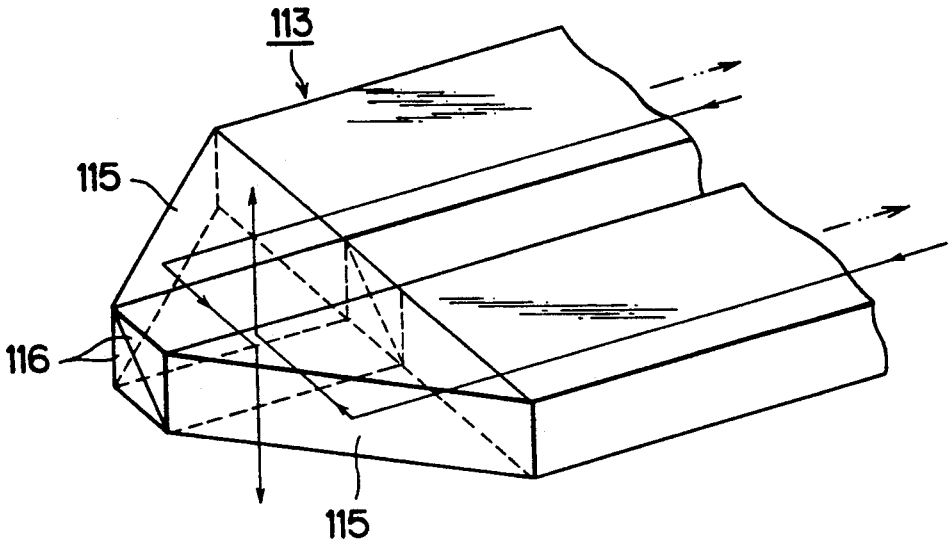
FIG. 6 is an enlarged perspective view of the pattern detector of the invention.
Figure 7:
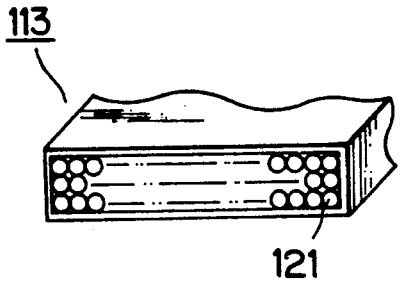
FIG. 7 is a perspective view showing an array of light-emitting and light-detecting optical fibers of the pattern detector of the invention.

The middle guide plate 104 is combined with the detector 113 for detecting pattern information of the fabrics 87 and 88. As shown in FIG. 6, the detector 113 has prisms 115 and 116 disposed in its distal end. Light beams are reflected by surfaces of the prisms 115 and 116 toward the fabrics 87 and 88, respectively. The light beams are then reflected at surfaces of the fabrics 87 and 88 and return to the prisms 115 and 116 where the light beams are reflected by the surfaces thereof to go back into the detector 113. As shown in FIG. 7, the detector 113 also has a bundle of optical fibers 121 which extend from the prisms 115 and 116 to a control box 124 attached to the sewing machine frame, as shown in FIGS. 1 and 2.

Figure 2:
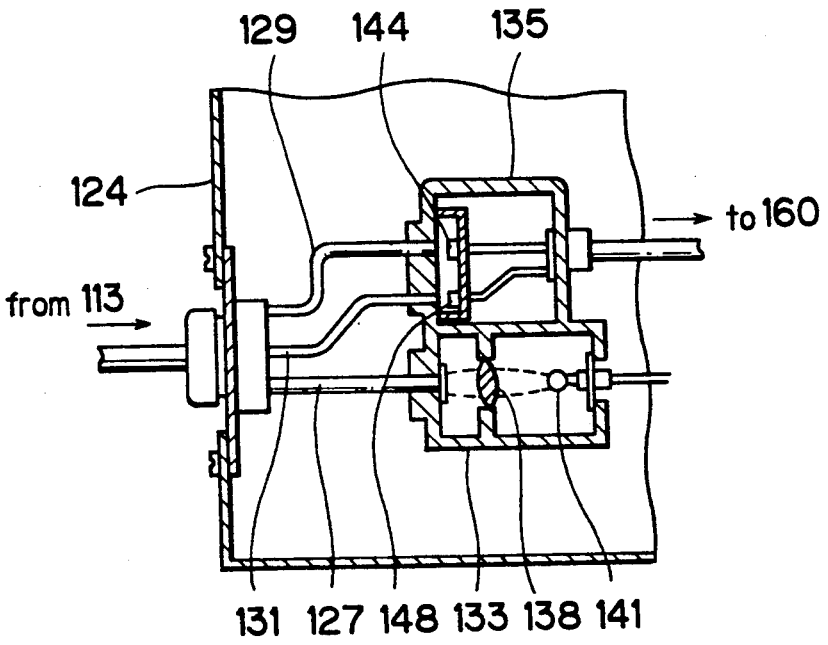
FIG. 2 is a cross-sectional view of a light-emitting unit and a light-detecting unit employed in the present invention.

As shown in FIG. 2, the bundle of the optical fibers 121 is composed of a bundle of light-emitting fibers 127 and two bundles of light-detecting fibers 129 and 131. The light-emitting fiber bundle 127 is connected to a light-emitting unit 133, and the light-detecting fiber bundles 129 and 131 are connected to a light-detecting unit 135. The light-detecting fiber bundles 129 and 131 are assigned respectively to the upper fabric 87 and the lower fabric 88. The light-emitting unit 133 has a light source 141 for emitting white light through a lens 138 to the end of the light-emitting fiber bundle 127. The light-detecting unit 135 has a color sensor 144 for detecting the light beam from the end of the light-detecting fiber 129 and a color sensor 148 for detecting the light beam from the end of the light-detecting fiber 131.

Figure 8:
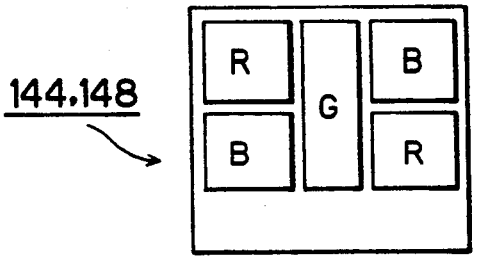
FIG. 8 is a view showing an arrangement of color sensors of the invention.

As shown in FIG. 8, each of the color sensors 144 and 148 includes a plurality of photodiodes with their light entrance windows being covered with red (R), green (G), and blue (B) color filters that pass lights of red, green, and blue with high sensitivity, respectively. As apparent from the figure, the color filters of the same colors are spaced from each other so that the color sensor has a wide detection range. That is, even if the light beams from the ends of the optical fibers 129 and 131 are somewhat shifted with respect to the entrance windows of the corresponding color sensors 144 and 148, the color sensors 144 and 148 can detect the lights of the respective colors highly efficiently.

According to the above-described structure, the white light emitted from the light source 141 passes through the light-emitting fiber bundle 127 and is reflected by the surfaces of the prisms 115 and 116 provided in the distal end of the detector 113 to reach the surfaces of the upper and lower fabrics 87 and 88. Light beams reflected by the surfaces of the upper and lower fabrics 87 and 88 travel back through the same light path as the emitted light beams and pass through the light-detecting fiber bundles 129 and 131, respectively. Then, the light beams are separated into three primary colors by the red, green and blue color filters and detected by the color sensors 144 and 148. The color sensor 144 produces three color component signals indicative of lightness values of the three primary color components of the light beam supplied from the upper fabric 87. The color sensor 148 produces three color component signals indicative of lightness values of the three primary color components of the light beam supplied from the lower fabric 88. The color component signals of six number in total are then supplied from the color sensors 144 and 148 to an electronic controller 160 which is also provided in the control box 124. The detector 113, the light-emitting unit 133, and the light-detecting unit 135 jointly constitute colored pattern detecting means.

Figure 3:
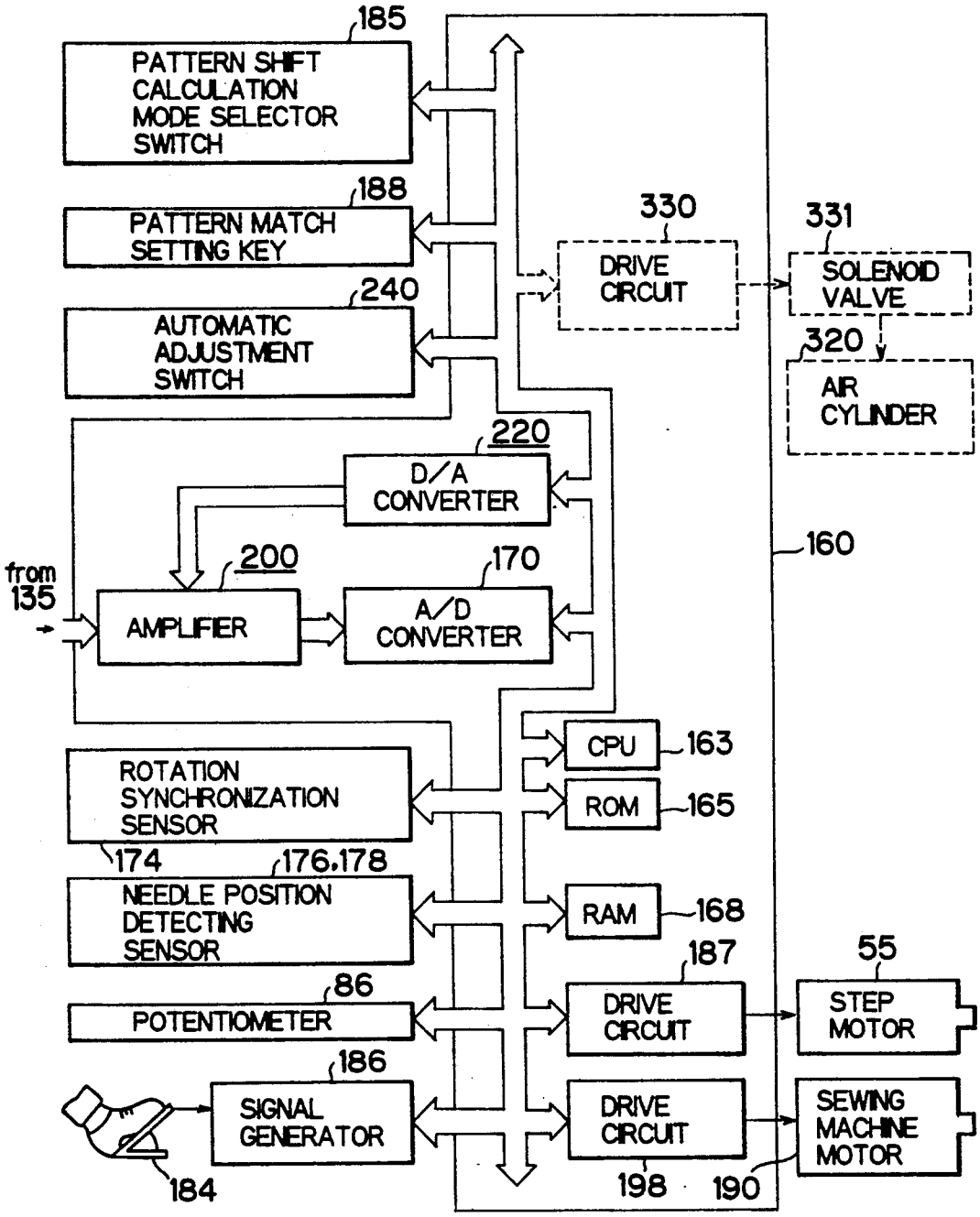
FIG. 3 is a block diagram showing an input/output arrangement of an electronic controller of the pattern matching sewing machine of the present invention.

As shown in FIG. 3, the electronic controller 160 includes a known CPU 163, a ROM 165, and a RAM 168. The electronic controller 160 further includes an amplifier 200 for amplifying voltage values of the color component signals outputted from the color sensors 144 and 148 with amplification factors which can be adjusted by a D/A converter 220, an A/D converter 170 for converting each signal amplified by the amplifier 200 into a digital signal, a driver 187 for driving the step motor 55 that adjusts the upper feed rate, and a driver 198 for driving a sewing machine motor 190 which is a drive source of the sewing machine. The CPU 163, the ROM 165, the RAM 168, the amplifier 200, the D/A converter 220, the A/D converter 170, the driver 187 and the driver 198 are all connected with one another through a bus.

To the electronic controller 160, there are connected a rotation synchronism sensor 174 mounted in the pulley 15 for producing a signal of 24 pulses per rotation of the main shaft 17, needle position sensors 176 and 178 mounted in the pulley 15 for producing signals indicative of upper and lower needle positions, the potentiometer 86 for detecting the feed rate of the lower fabric, a signal generator 186 coupled to a foot pedal 184 for generating start and stop signals, a pattern shift amount calculating mode selector switch 185 for selecting one of pattern shift calculating modes 1, 2, and 3, a pattern match setting key 188 for setting the information on the patterns of the upper and lower fabrics 87 and 88, and an automatic adjustment switch 240 for starting the automatic white balance adjusting process. The pattern shift calculating modes 1, 2, and 3 correspond to respective algorithms stored in the ROM 165 for calculating a pattern shift amount, as described in a Japanese Laid-Open Patent Publication No. 1-192388, and therefore, the explanation of the algorithms is omitted from this description.

Figure 9:
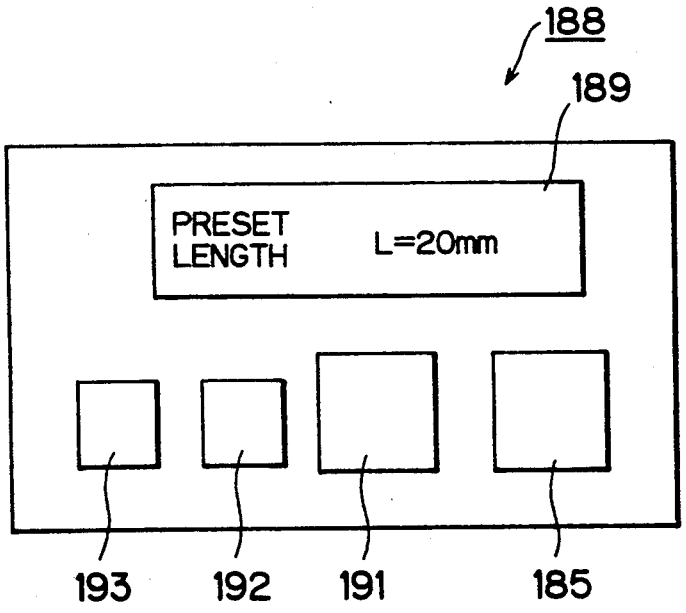
FIG. 9 is a view showing an appearance of a control panel of the invention.

As shown in FIG. 9, the pattern match setting key 188 includes various push-button keys provided on a control panel which is attached to the sewing machine frame and which has a liquid-crystal display unit 189 for displaying letters and numbers. The pattern match setting key 188 includes a pattern interval varying key 191 for instracting a change of a pattern interval, incremental and decremental keys 192 and 193 for incrementing and decrementing the number indicative of the pattern interval to be varied. The above-described pattern shift calculating mode selector switch 185 is also provided as a push-button switch on the control panel of the pattern match setting key 188.

Figure 12:
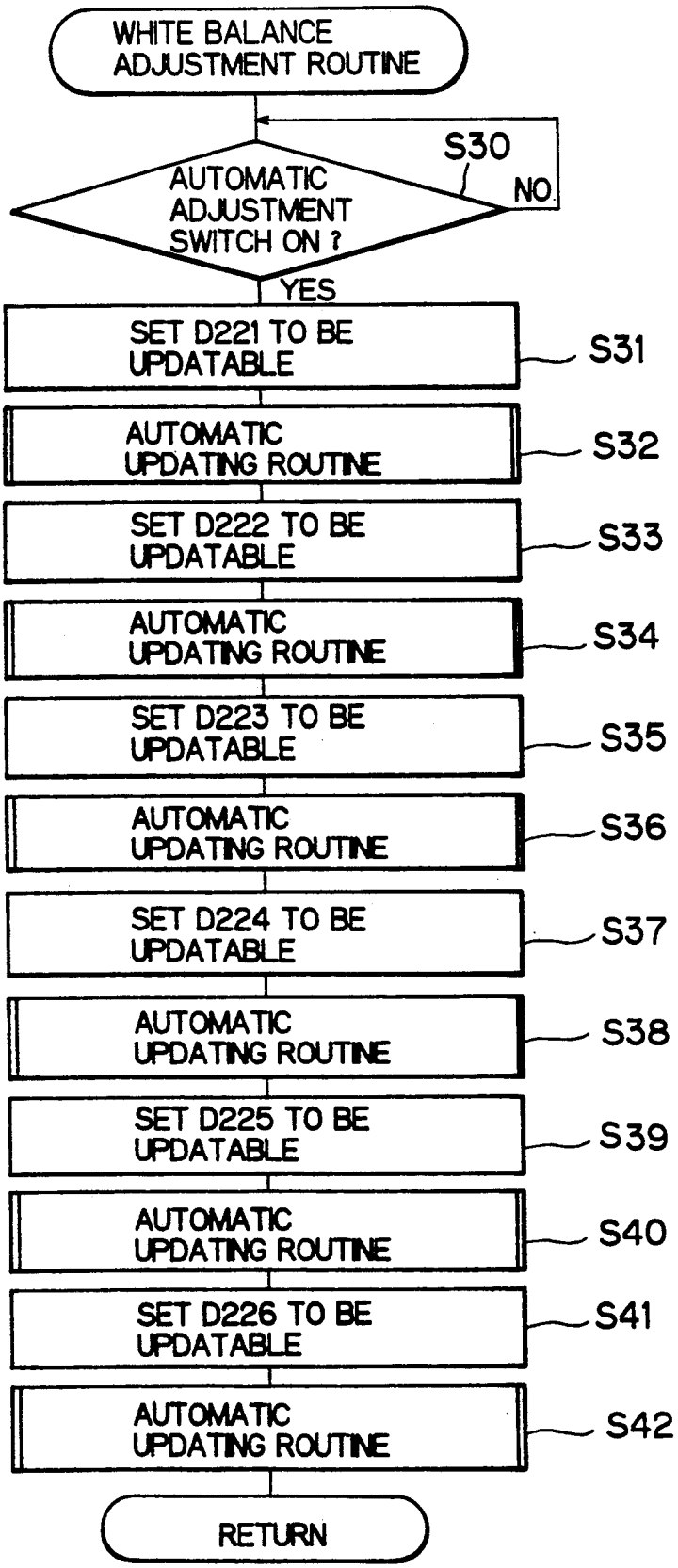
FIG. 12 is a flowchart of an automatic white balance adjustment routine effected on the pattern matching sewing machine of the first and second embodiments.
Figure 13:
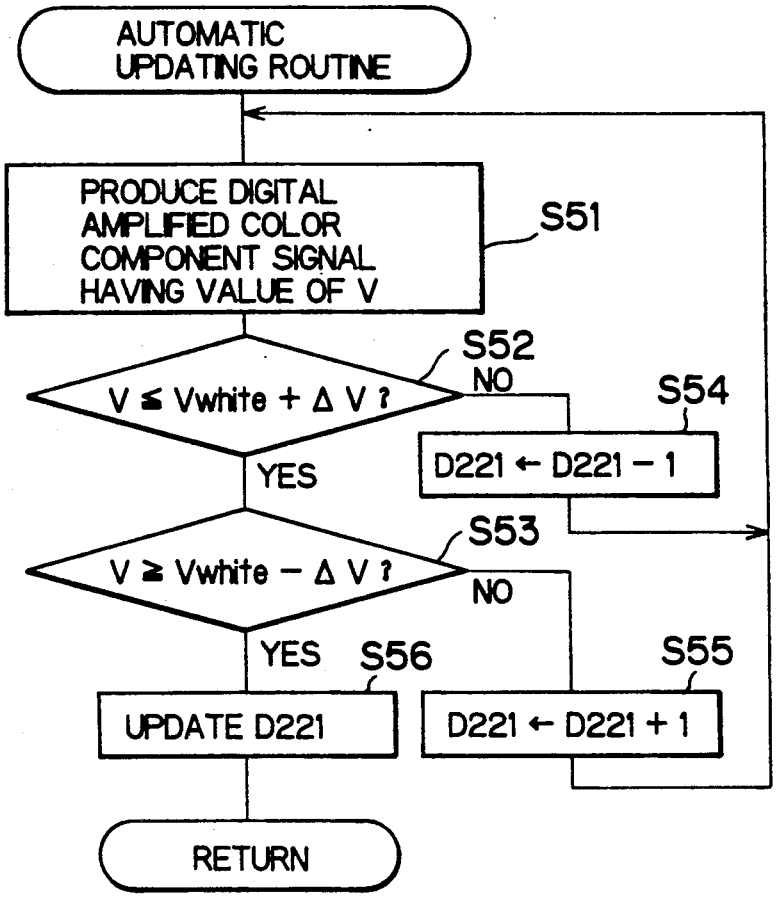
FIG. 13 is a flowchart of an updating routine in the white balance adjustment routine of the first and second embodiments.

The ROM 165 stores therein a program for conducting a pattern matching operation and a program for conducting a white balance adjusting operation shown in FIGS. 12 and 13. The RAM 168 has a predetermined number Cm of memory areas for successively storing color component signals sampled by the color sensors 144 and 148. As the program of the pattern matching operation stored in the ROM 165, various manners may be employed. For example, the U.S. Pat. Nos. 4,901,659, 4,898,110, 4,982,677 disclose various types of pattern matching operations conductable by the pattern matching sewing machine 1 of the present invention.

The RAM 168 also stores therein six amplification data Aur, Aug, Aub, Alr, Alg and Alb determined for the amplifier 200 which will be described later. The RAM 168 is always backed up by a backup power supply (not shown in the drawing) so that it can always store necessary data.

Figure 10:
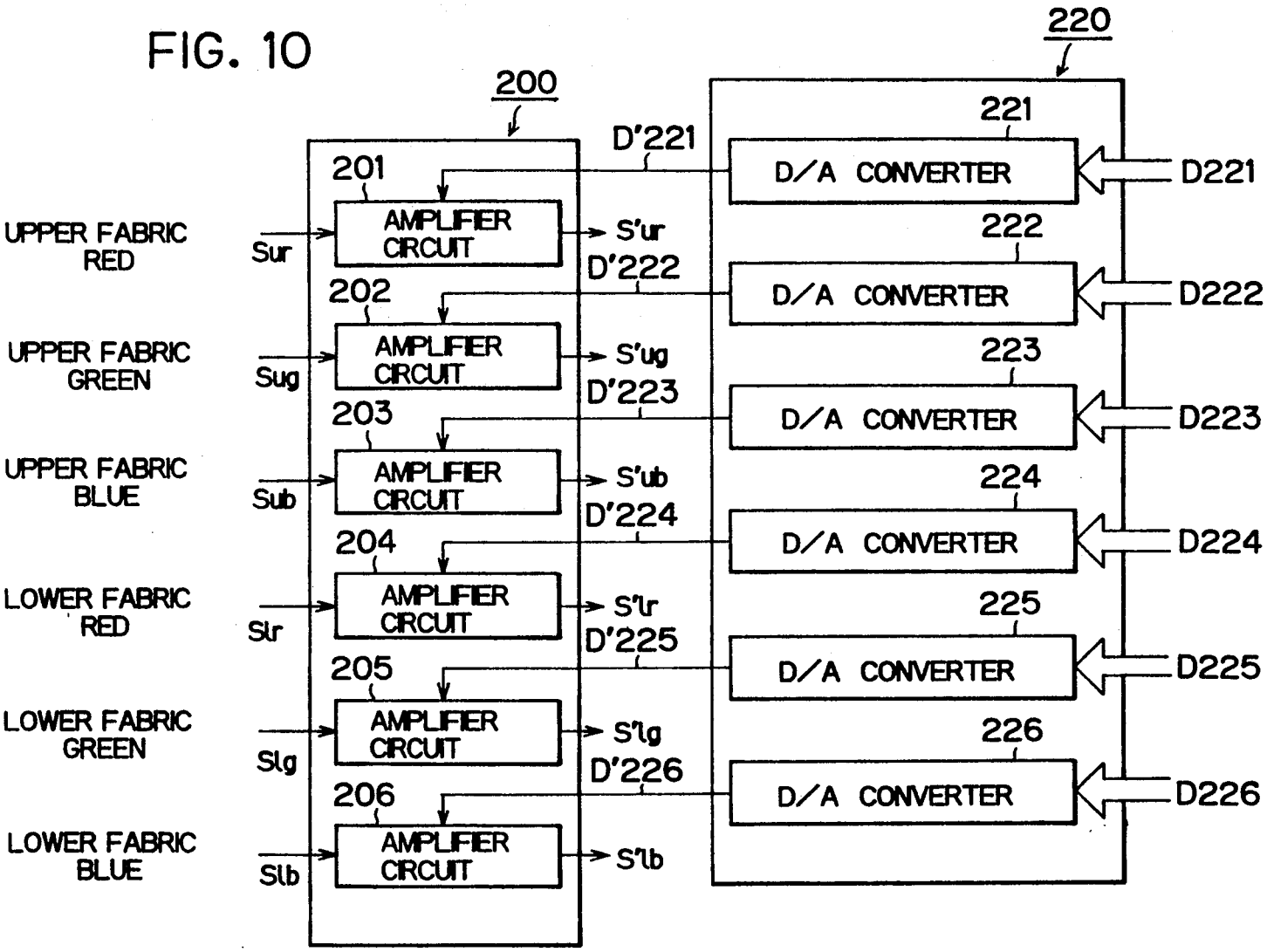
FIG. 10 is a block diagram showing a detailed arrangement of an amplifier and a D/A converter in the first and second embodiments.

As shown in FIG. 10, the amplifier 200 in the electronic controller 160 includes six amplifying circuits 201 through 206. The three amplifying circuits 201 through 203 respectively receive the three color component signals Sur, Sug and Sub outputted from the color sensor 144 for the red, green and blue color components of the upper fabric 87 and analog amplifier control signals D'221 through D'223 outputted from the D/A converter 220. The amplifying circuits 201–203 therefore respectively amplify the signals Sur, Sug and Sub, with amplification factors Fur, Fug and Fub which are determined dependently on the amplifier control signals D'221–D'223, to thereby produce amplified signals Sur', Sug' and Sub'. The remaining three amplifying circuits 204 through 206 respectively receive the three color component signals Slr, Slg and Slb outputted from the color sensor 148 for the red, green and blue color components of the lower fabric 88 and amplifier control signals D'224 through D'226 outputted from the D/A converter 220. The amplifying circuits 204–206 therefore respectively amplify the signals Slr, Slg and Slb, with amplification factors Flr, Flg and Flb which are determined dependently on the amplifier control signals D'224–D'226, to thereby produce amplified signals Slr', Slg' and Slb'.

As also shown in FIG. 10, the D/A converter 220 includes six D/A converter circuits 221 through 226 for converting digital amplifier control signals D221 through D226 into the analog amplifier control signals D'221 through D'226. The digital amplifier control signals D221 through D226 are outputted from the CPU 163 dependently on the amplification data Aur, Aug, Aub, Alr, Alg and Alb stored in the RAM 168 which are indicative of the amplification factors Fur, Fug, Fub, Flr, Flg and Flb of the respective amplifying circuits 201 through 206.

With the above-described structure, the amplifying circuit 201 receives a red color component signal Sur from the color sensor 144 which is indicative of a red color component of the pattern of the upper fabric 87 and amplifies a voltage value of the signal Sur with the amplification factor Fur which is determined responsive to the analog amplfier control signal D'221 outputted from the D/A converter circuit 221. Similarly, the amplifying circuits 202 and 203 amplify voltage values of the green and blue color component signals Sug and Sub indicative of green and blue color components of the pattern of the upper fabric 87, with the amplification factors Fug and Fub determined dependently on the analog amplfier control signals D'222 and D'223 outputted from the D/A converters 222 and 223. In similar manner, the amplifying circuits 204, 205 and 206 respectively amplify red, green and blue color component signals Slr, Slg and Slb indicative of the three color components of the pattern of the lower fabric 88, with the amplification factors Flr, Flg and Flb determined dependently on the analog amplifier control signals D'224 through D'226. As a result, the amplifier 200 produces six number of amplified color component signals Sur', Sug', Sub', Slr', Slg' and Slb' indicative of all the three color components of the patterns of both the upper and lower fabrics 87 and 88. Thus obtained amplified color component signals Sur' through Slb' in analog form are then converted into digital amplified color component signals Sur", Sug", Sub", Slr", Slg" and Slb" by the A/D converter 170. The digital amplified color component signals Sur" through Slb" are stored in the RAM 168.

The CPU 163 conducts the pattern matching routine stored in the ROM 165 with the use of the amplified color component digital signals Sur" through Slb" which are stored in the RAM 168. More specifically, the CPU 163 uses the amplified digital color component signals Sur" through Slb" as information representative of the colors of the patterns of the fabrics 87 and 88 for calculation of the shift amount (mismatch amount) of the fabrics. Details of the pattern matching operation are disclosed in the already-cited United States Patents.

Hereinafter, white balance of the pattern matching sewing machine 1 defined in the present embodiment will be described in detail. In the color pattern matching operation employed in the present embodiment, as described above, the amplified color component digital signals Sur" through Slb" obtained through the amplifier 200 and the A/D converter 170 are used as data indicative of the colors of the patterns of the fabrics 87 and 88. Therefore, according to the present embodiment, white balance should be properly obtained with respect to the amplified digital color component signals Sur" through Slb". More specifically to say, the amplification data Aur, Aug, Aub, Alr, Alg and Alb stored in the RAM 168 indicative of the amplification factors Fur, Fug, Fub, Flr, Flg and Flb of the amplifier 200 should be selected to have such values as attaining a proper white balance between the digital color component signals Sur", Sug", Sub", Slr", Slg" and Slb".

Figure 11:
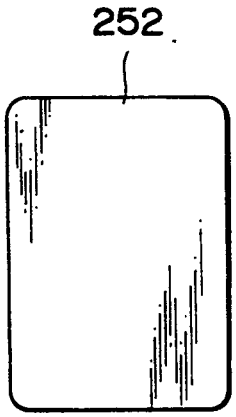
FIG. 11 is a view of a white balance reference board in the first embodiment.

The white balance for the pattern matching sewing machine 1 is detected with the use of a pair of white balance reference boards 252 shown in FIG. 11. That is, in order to detect the white balance, the pair of white balance reference boards 252 are inserted between the fabric guide plates 103 and 104 and between the fabric guide plates 104 and 105, instead of the fabrics 87 and 88. Each of the white balance reference boards 252 is coated with a white paint as shown in FIG. 11 and serves to give optical white reference informations to the color sensors 144 and 148, as follows.

White light beams emitted from the light-emitting unit 133 are reflected by surfaces of the white balance reference boards 252 positioned between the guide plates. Three color component signals Swur, Swug and Swub of red, green and blue are therefore produced by the color sensors 144 for representing white color of the refernece board 252 (upper board) placed between the guide plates 103 and 104, and three color component signals Swlr, Swlg and Swlb of red, green and blue are produced by the color sensors 148 for representing white color of the refernece board 252 (lower board) placed between the guide plates 104 and 105. (The color component signals will be referred to as "white reference color component signals Swur-Swlb", hereinafter.) Thus, six white reference color component signals Swur-Swlb are produced in total by the sensors 144 and 148.

The six white reference color component signals Swur-Swlb are then amplified by the corresponding amplifier circuits 201 through 206 with the amplification factors Fur-Flb determined responsive to the amplifier control signals D221 through D226 which are produced by the CPU 163 based on the amplification data Aur-Alb stored in the RAM 168. Six white reference color component signals Swur'-Swlb' obtained through the amplification operations are then converted into corresponding six digital white reference color component signals Swur"-Swlb" by the A/D converter 170. If all of the six digital white reference color component signals Swur"-Swlb" have voltage values which fall within a predetermined white level range Vwhite$\pm\Delta$V, then it is determined that the white balance is properly obtained for the sewing machine 1. Or otherwise, if either one or ones of the six digital white reference color component signals Swur"-Swlb" have voltage values which fail to fall within the white level range Vwhite$\pm\Delta$V, then it is determined that the white balance is not properly obtained.

Since the white balance for the pattern matching sewing machine 1 is defined as described above, according to the present embodiment, a process for automatically adjusting the white balance is attained, as described below.

The automatic white balance adjustment may not always be carried out, but can be initiated only when the setting operation of the pattern match setting key 188 is possible, the three fabric guide plates 103, 104 and 105 are closed to prevent extraneous light from entering the detector 113, and the automatic adjustment switch 240 is operated on. This is because the automatic adjustment process should not be effected in error while a pattern shift amount is being calculated or pattern matching operation is being effected for the fabrics 87 and 88 placed between the guide plates.

Therefore, according to the embodiment, immediately after the power supply of the pattern matching sewing machine 1 is turned on, the automatic white balance adjusting operation is conducted, since the setting operation of the pattern match setting key 188 cannot yet have been conducted at this time, and the fabrics cannot yet have been inserted between the guide plates.

With nothing previously inserted between the fabric guide plates 103, 104 and 105, the operator employs the two white balance reference boards 252, inserts them between the fabric guide plates 103 and 104 and between the fabric guide plates 104 and 105 and closes the guide plates so that the guide plates tightly sandwich the boards 252 therebetween. Then, the CPU 163 starts the automatic white balance adjustment process shown in FIG. 12. First, in a step S30, the CPU 163 is suspended in a standby condition until when the operator operates on the automatic adjustment switch 240. If the automatic adjustment switch 240 is pressed in the standby condition, the CPU 163 then changes the amplifier control digital signal D221 into such a condition as being updatable, in step S31. More specifically, the CPU 163 manipulates a flag or the like in the automatic white balance adjusting program to change the RAM 168 into a condition that values of the amplification data Aur-Alb stored therein can be updated.

In the state that the digital amplifier control signal D221 can be updated, an amplifier control signal updating routine shown in FIG. 13 is executed in a step S32, as a subroutine of the automatic white balance adjustment routine.

Then, the digital amplifier control signal D222 is changed into such a condition as being updatable, in a step S33, and then the amplifier control signal updating routine shown in FIG. 13 is executed in a step S34. Likewise, the digital amplifier control signals D223, D224, D225 and D226 are changed into such a condition as being updatable in steps S35, S37, S39 and S41, before the amplifier control signal updating routine is executed therefor in steps S36, S38, S40 and S42.

Thus, the amplifier control signal updating routine shown in FIG. 13 is executed six times for the six digital amplifier control signals D221-D226. The amplifier control signal updating routine will be described in detail below with reference to FIG. 13. In FIG. 13, only the amplifier control signal updating routine for updating the digital amplifier control signal D221 is shown by way of example.

In this routine, in a step S51, the white reference red color component signal Swur outputted from the color sensor 144 is amplified in the amplifying circuit 201 with the amplification factor Fur determined dependently on the amplifier control signal D221 which is produced by the CPU 163 in responsive to the amplification data Aur now stored in the RM 168. The amplified white reference red color component signal Swur' is then converted by the A/D converter 170 into a digital white reference red color component signal Swur" having a digital voltage value of V, also in the step S51. Then, steps S52 and S53 determine whether the digital voltage value V falls in the predetermined white balance voltage range Vwhite$\pm\Delta$V stored in the ROM 165.

More specifically to say, if the digital value V is higher than the upper limit Vwhite$+\Delta$V of the white balance voltage range Vwhite$\pm\Delta$V, then a value 1 is subtracted from the value of the digital amplifier control signal D221, in a step S54. Thereafter, the step S51 is executed again. Since the value of the digital amplifier control signal D221 determines the value of the amplification factor Fur of the amplifying circuit 201, the digital value V obtained in the step S51 at this time becomes smaller than the value V obtained in the previously conducted step S51. The step S52 determines again whether or not thus reduced digital voltage V is equal to or less than the upper limit Vwhite$+\Delta$V. The steps S54, S51 and S52 are repeated until when the digital voltage V falls within the white balance output range Vwhite $\pm\Delta$V.

If the digital voltage V is lower than the white balance lower limit Vwhite$-\Delta$V of the white balance voltage range Vwhite$\pm\Delta$V, then a value 1 is added to the value of the digital amplifier control signal D221, in a step S55. The steps S55, S51 and S53 are repeated until when the digital voltage V falls within the white balance voltage range Vwhite$\pm\Delta$V.

If the answers to the steps S52 and S53 finally become affirmative as a result of the repeated procedure, then in step S56, the amplification data Aur stored in the RAM 168 is updated to have such a value that the amplifier control signal D221 to be produced on the basis of the dada Aur may be updated to have the value obtained through the steps S54 and S55. (It should be noted that if the answers to the steps S52 and S53 are affirmative in the first cycle, then no updating of the stored value is effected.) Accordingly, the value of the amplification data Aur is properly selected for attaining a proper white balance for the signal Swur" obtained from the upper white board 252. Thus, the white balance adjustment is completed for the red color component signals Sur" to be obtained from the upper fabric.

Through the steps S34, S36, S38, S40 and S42 of the white balance adjustment routine, the same white balance adjustment is further carried out for the green and the blue color component signals Swug" and Swub" obtained from the upper board 252, and the red, green and blue color component signals Swlr", Swlg" and Swlb" obtained from the lower board 252. Thus, a proper white balance is attained for all the six color component signals Sur"-Slb" to be obtained in the sewing machine 1 from both the upper and lower fabrics. In other words, values of all the six amplification data Aur-Alb are properly selected for attaining the white balance for the signals Sur"-Slb".

According to the present embodiment, since the proper white balance can be automatically attained as described above, the shift (mismatch) amount of the patterns of the upper and lower fabrics can be calculated accurately and the pattern matching operation can be properly conducted.

As described above, the pattern matching sewing machine 1 can automatically adjust the white balance. The operator can effect the white balance adjustment simply by inserting the white balance reference boards 252 between the fabric guide plates 103 and 104 and between the fabric guide plates 104 and 105, and operating on the automatic adjustment switch 240. Accordingly, the adjustment process requires no skill on the part of the operator, and can be effected in a short period of time.

Furthermore, since there is no need for the switches of variable resistors, the pattern matching sewing machine 1 is made up of a small number of components, and those switches would not be operated on in error after the pattern matching sewing machine 1 is shipped.

Though the automatic adjustment switch 240 is used in the above description, the automatic adjustment switch 240 may be dispensed with. In this case, the material of the fabric guide plates 103 and 105 is selected such that the values of the digital amplified color component signals Sur"-Slb" obtained at the time when nothing is inserted between the fabric guide plates differ from those Swur"-Swlb" produced at the time when the white balance reference boards 252 are inserted between the fabric guide plates. A threshold value is determined based on the difference between those digital values and is stored as an adjustment starting condition in the ROM 165. According to such a structure, when color comopnent signals Swur"-Swlb" having values higher than the stored threshold value are produced within a certain period of time after the pattern matching sewing machine 1 is switched on, the white balance adjustment process may be automatically started.

If the pattern matching sewing machine has a thread breakage switch, then the automatic adjustment process may be initiated upon completion of a thread cutting operation.

Figure 14:
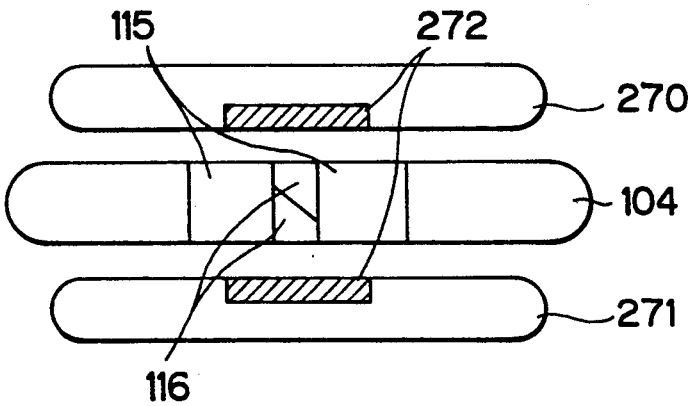
FIG. 14 is a cross-sectional view showing fabric guide plates of the second embodiment.

A second preferred embodiment of the present invention will be described below, with reference to FIG. 14. A pattern matching sewing machine according to the second embodiment is almost the same with that of the first embodiment, both in its structure and in its function. The pattern matching sewing machine 1 of the second embodiment differs from that of the first embodiment, only in its structure of the upper and lower fabric guide plates. That is, as shown in FIG. 14, instead of the fabric guide plates 103 and 105, the sewing machine of the second embodiment is provided with an upper guide plate 270 and a lower guide plate 271 in which there are embeded a pair of white balance reference boards 272. In the second embodiment with such the guide plates 271 and 272, it becomes unnecessary for the operator to insert the white reference boards between the guide plates. The operator may start the automatic white balance adjustment process simply by pressing the automatic adjustment switch 240.

In this case, the sewing machine may be further provided with limit switches for determining whether or not fabrics are inserted between the fabric guide plates 270, 104 and 272. Immediately after when the pattern matching sewing machine is switched on, the limit switches confirm that no fabric is inserted between the guide plates, and then the white balance adjustment process is automatically conducted. Use of such limit switches further simplifies the white balance adjustment process, since the operator is not required to take any intentional action such as the pressing operation of the automatic adjustment switch 240 to effect the white balance adjustment process.

A third preferred embodiment of the present invention will be described below, with reference to FIGS. 3 and 15 through 23. According to a pattern matching sewing machine 1 of the third embodiment, not only the white balance but also the dynamic range may be automatically adjusted. Therefore, in this embodiment, white and black level adjustment program shown in FIGS. 20 through 23 are stored in the ROM 165, instead of the white balance adjustment program shown in FIG. 12 and 13 of the first embodiment. The RAM 168 stores therein not only the amplification data Aur–Alb but also six reference level data Rur, Rug, Rub, Rlr, Rlg and Rlb as will be described later.

Furthermore, upper and lower guide plates 303 and 305 with color reference board 315 provided therein shown in FIGS. 15, 16, 18 and 19 are employed in this embodiment, instead of the upper and lower fabric guide plates 103 and 105 of the first embodiment. The sewing machine of the present embodiment is provided with the amplifier 200 and the D/A converter 220 as shown in FIG. 17, instead of them shown in FIG. 10 of the first embodiment. The electronic controller 160 of the present embodiment not only includes the elements included in the electronic controller 160 of the first embodiment, but also includes a driver circuit 330 for driving an air cylinder 320 through a solenoid valve 331, as indicated by dotted line in the FIG. 3. In the present embodiment, the automatic adjustment switch 240 of the first embodiment is not employed, and therefore the electronic controller 160 is not connected to the switch. Except for the above-described differences of the sewing machine of the present embodiment from that of the first embodiment, the sewing machine of the present embodiment is the same as that of the first embodiment, in its structure and function. Therefore, explanations of the same structure and function is omitted from the following description.

Figure 15:
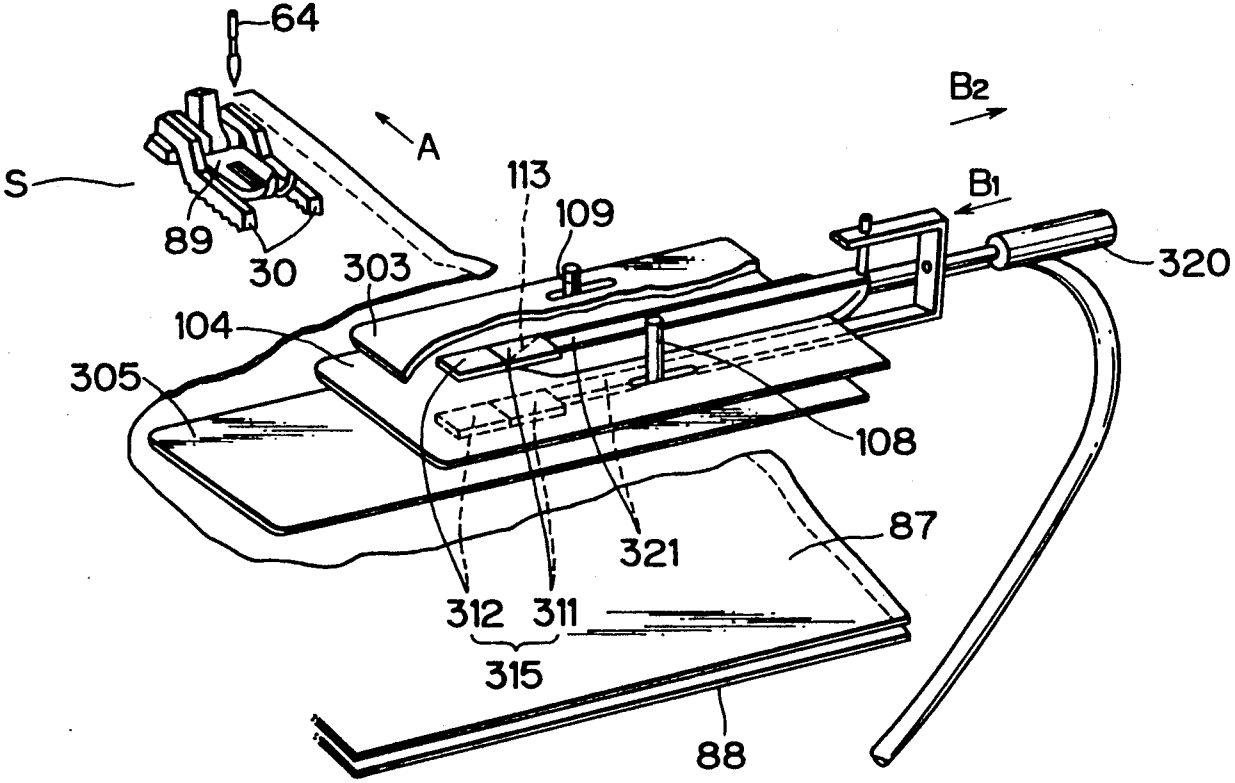
FIG. 15 is a perspective view of a pattern detecting portion of a pattern matching sewing machine according to a third embodiment of the present invention.
Figure 16:
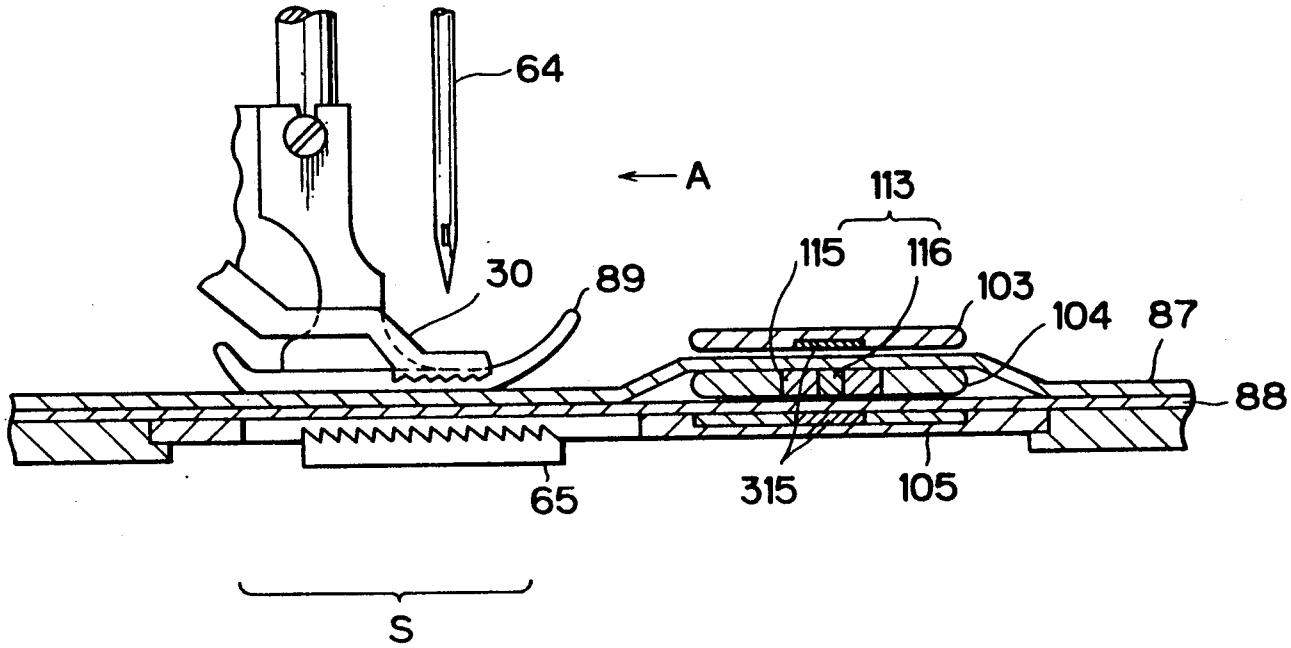
FIG. 16 is a fragmentary cross-sectional view illustrative of a stitch forming region S of the sewing machine of the third embodiment.
Figure 17:
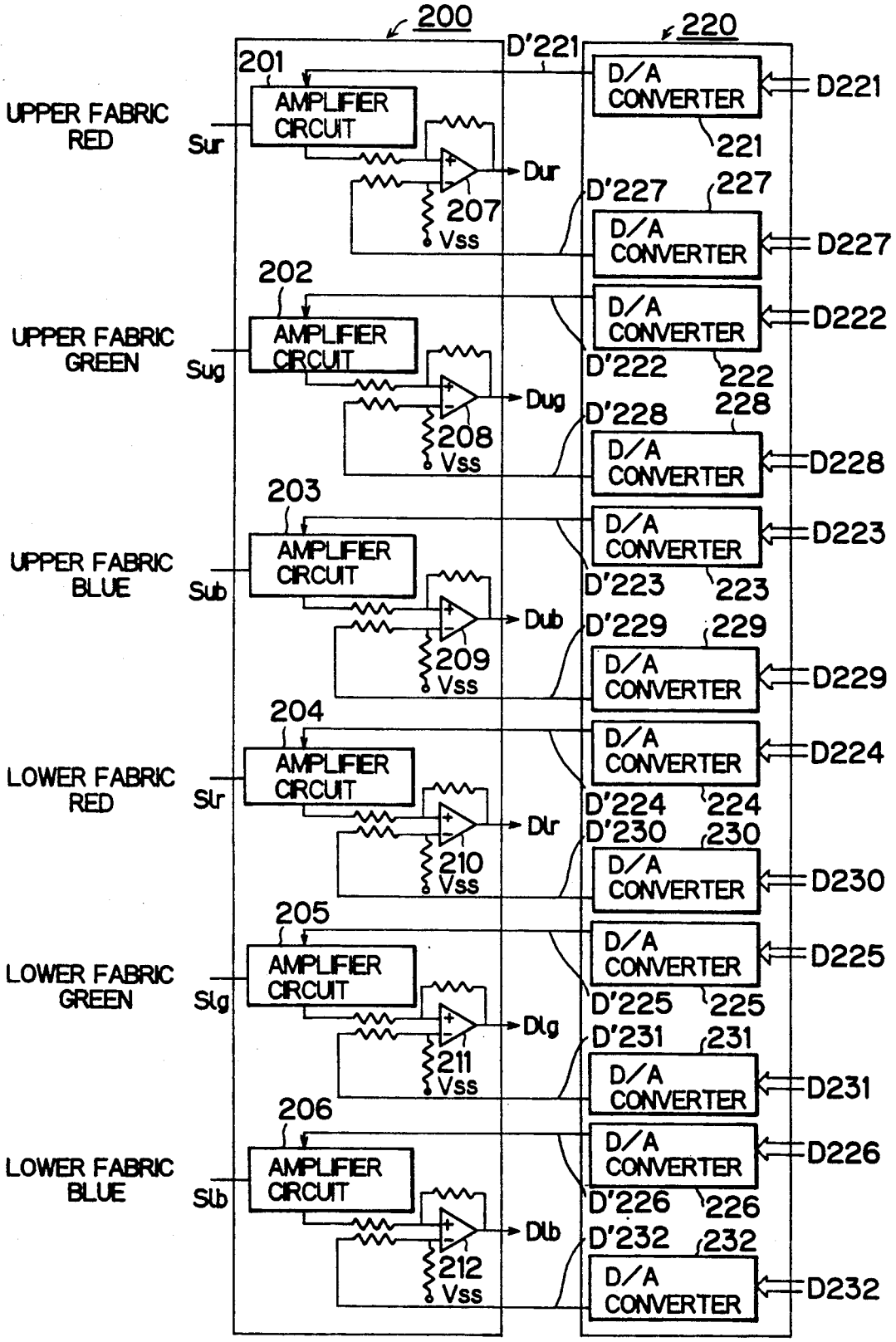
FIG. 17 is a block diagram showing a detailed arrangement of an amplifier and a D/A converter in the third and fourth embodiments.

In the pattern matching sewing machine 1 of the present embodiment, the upper and lower fabric guide plates 303 and 305 are employed, as shown in FIGS. 15 and 16. In each of the guide plates 303 and 305, the color reference board 315 is slidably mounted. The color reference board 315 has, on its surface confronting the middle guide plate 104, a black color area 311 coated with black paint and a white color area 312 coated with white paint which are arranged along directions indicated by the arrows B1 and B2 which are perpendicular to the fabric feeding direction indicated by the arrow A. The color reference boards 315 in the upper and lower fabric guide plates 303 and 304 are fixed to operational levers 321 which are slidingly movable in accordance with a sliding movement of an air cylinder 320 in the direction indicated by the arrows B1 and B2. Therefore, the color reference boards 315 in the upper and lower fabric guide plates 303 and 305 are slidingly movable in the direction indicated by the arrows B1 and B2 relative to the middle guide plate 104 so that the black and white color areas 311 and 312 may alternately be moved into a position confronting the prisms 115 and 116 of the detector 113 mounted on the middle guide plate 104. Accordingly, with the state that no fabric is inserted between the guide plates, the color sensors 144 and 148 obtain six color component signals Sbur, Sbug, Sbub, Sblr, Sblg and Sblb for black reference color at the time when the black color areas 311 of the guide plates 304 and 305 confront the prisms 115 and 116, and the color sensors 144 and 148 obtain six color component signals Swur, Swug, Swub, Swlr, Swlg and Swlb for white reference color at the time when the second color areas 312 confront the prisms. In other words, the air cylinder 320 serves to switch a color to be detected by the color sensors between black and white.

Since the above-described air cylinder 320 and the operational lever 321 are mounted in the pattern matching sewing machine 1 of the third embodiment, the electronic controller 160 includes, as indicated by dotted line in FIG. 3, the driver circuit 330 for driving a solenoid valve 331 which allows high-pressure air to be introduced into and discharged from the air cylinder 320.

In the third embodiment, as shown in FIG. 17, the amplifier 200 in the electronic controller 160 has not only the six amplifying circuits 201 through 206 as in the first embodiment but also six differential amplifier circuits 207 through 212 with their positive input terminals connected to output terminals of the amplifying circuits 201 through 206, respectively. The D/A converter 220 includes not only the six D/A converter circuits 221 through 226 for D/A converting the digital amplifier control signals D221 through D226 as in the first embodiment but also six D/A converter circuits 227 through 232 for D/A converting digital reference voltage signals D227 through D232. The digital reference voltage signals D227 through D232 are produced from the CPU 163 dependently on the reference level data Rur, Rug, Rub, Rlr, Rlg and Rlb stored in the RAM 168. The D/A converter circuits 227 through 232 convert the digital reference voltage signals D227 through D232 into analog signals D'227–D'232, respectively, and supply them into negative input terminals of the differential amplifier circuits 207 through 212.

With such a structure, the amplifying ciruits 201 through 206 respectively receive the six color component signals (i.e., red, green and blue color component signals Sur, Sug and Sub from upper fabric 87 and red, green and blue color component signals Slr, Slg and Slb from lower fabric 88) from the color sensors 144 and 148. The amplifying circuits 201 through 206 amplify the values of the six color component signals Sur–Slb with the amplification factors Fur–Flb determined dependently on the amplifier control signals D'221 through D'226 which are D/A converted by the D/A converters 221 through 226. The differential amplifier circuits 207 through 212 respectively receive thus amplified six color component signals Sur'–Slb' and the reference voltage signals D'227 through D'232 which are D/A converted by the D/A converters 227 through 232. Accordingly, the differential amplifier circuits 207 through 212 respectively output difference signals Dur, Dug, Dub, Dlr, Dlg and Dlb indicative of differences between the voltage values of the amplified color component signals Sur', Sug', Sub', Slr', Slg' and Slb' and corresonding reference levels Eur, Eug, Eub, Elr, Elg and Elb which are determined dependently on the reference voltage signals D'227 through D'232. Thus obtained difference signals Dur-Dlb in analog form are then converted into digital difference signals Dur'-Dlb' by the A/D converter 170 and are stored in the RAM 168.

The CPU 163 conducts the pattern matching routine stored in the ROM 165 with the use of the digital difference signals Dur'-Dlb' stored in the RAM 168. More specifically to say, the CPU 163 uses the difference signals Dur'-Dlb' as color informations representative of the colors of the patterns of the upper and lower fabrics 87 and 88 for calculation of the shift amount (mismatch amount) of the fabrics. Therefore, according to the present embodiment, white and black levels should be properly adjusted with respect to the digital difference signals Dur'-Dlb'. More specifically to say, according to the present embodiment, the reference level data Rur-Rlb stored in the RAM 168 indicative of the reference levels Eur-Elb should be selected to have such values as attaining a proper black level for the digital difference signals Dur'-Dlb'. Furthermore, the amplification data Aur-Alb stored in the RAM indicative of the amplification factors Fur-Flb should be selected to have such values as attaining a proper white level for the digital difference signals Dur'-Dlb'.

The black and white levels of the sewing machine of the third embodiment are detected as will be described below.

Figure 18:
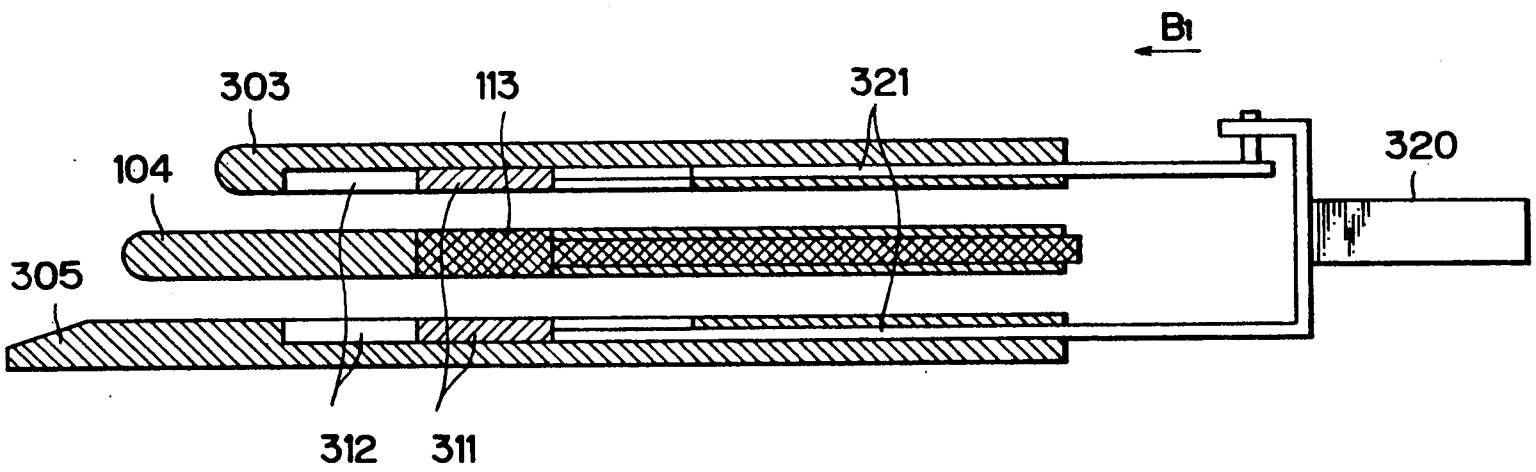
FIG. 18 is a cross-sectional view of fabric guide plates of the third embodiment with the black color areas confronting the detector unit.

When the solenoid valve 331 is turned on, the air cylinder 320 slidingly moves the operational lever 321 in the direction indicated by arrow B1, so that the black color areas 311 of the color reference boards 315 confront the prisms 115 and 116 of the detector 113 in the middle guide plate 104, as shown in FIG. 18. Accordingly, in this state, the color sensor 144 produces three color component signals Sbur, Sbug and Sbub indicative of three color components (red, green and blue) of the black color of the color reference board 315 (upper board) provided in the upper giude plate 304, and the color sensor 148 produces three color component signals Sblr, Sblg and Sblb indicative of three color components (red, green and blue) of the black color of the color reference board 315 (lower board) provided in the lower giude plate 305. (Thus obtained six color component signals will be referred to as "black reference color component signals Sbur-Sblb", hereinafter.) Since each of the six black reference color component signals Sbur-Sblb has the lowest values obtainable by the color sensors 144 and 148, it is necessary that differences between the values of all the six black reference color component signals Sbur-Sblb and the corresponding reference level voltages Eur-Elb fall within a predetermined low level range Vlow±ΔV which is stored in the ROM 165. In the case where all the differences fall within the predetermined low level range, the black level is properly adjusted in the sewing machine.

Figure 19:
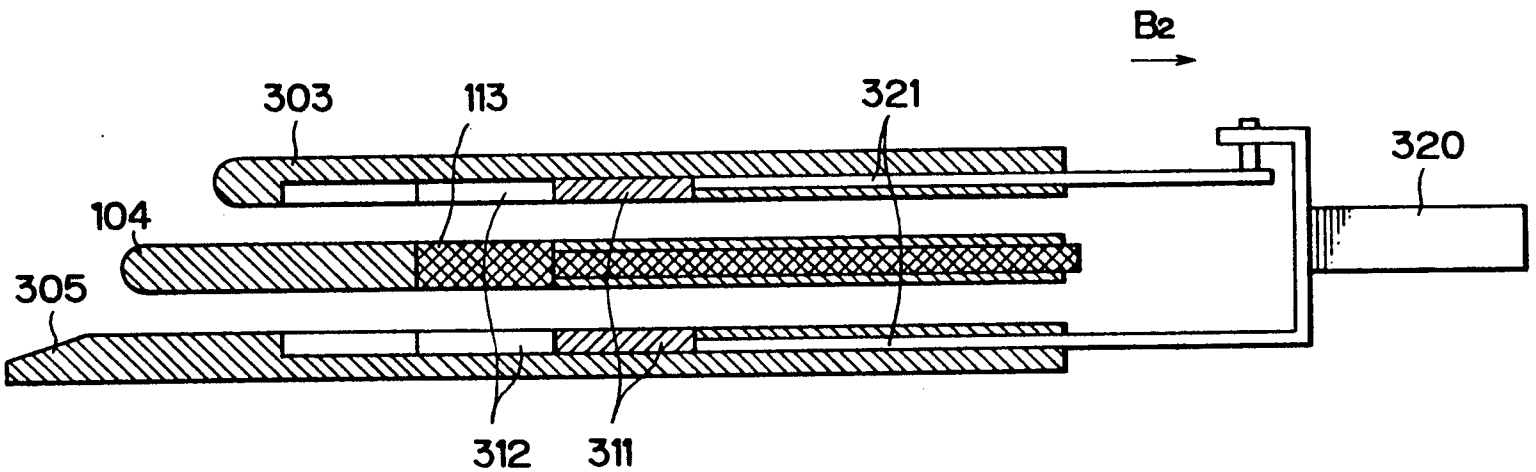
FIG. 19 is a cross-sectional view of fabric guide plates of the third embodiment with the white color areas confronting the detector unit.

On the other hand, when the solenoid valve is turned on, the air cylinder 320 slidingly moves the operational lever 321 in the direction indicated by arrow B2, so that the white color areas 312 of the color reference boards 315 confront the prisms 115 and 116 of the detector 113, as shown in FIG. 19. Accordingly, in this state, the color sensor 144 produces three color component signals Swur, Swug and Swub indicative of three color components (red, green and blue) of the white color of the color reference board 315 (upper board) provided in the upper giude plate 304, and the color sensor 148 produces three color component signals Swlr, Swlg and Swlb indicative of three color components (red, green and blue) of the white color of the color reference board 315 (lower board) provided in the lower giude plate 305. (Thus obtained six color component signals will be referred to as "white reference color component signals Swur -Swlb", hereinafter.) Thus obtained six white reference color component signals Swur-Swlb are amplified in the respective amplifier circuits 201 through 207 with the amplification factors Fur-Flb determined dependently on the corresponding amplifier control signals D'201 through D'206. Then, the differential amplifier circuits 207 through 212 respectively output signals Dwur-Dwlb indicative of differences between the voltage values of thus amplified six white reference color component signals Swur'-Swlb' and the corresponding reference level voltage values Eur-Elb determined dependently on the reference voltage signals D'227 through D'232. Since each of the six white reference color component signals Swur-Swlb has the highest value obtainable by the color sensors 144 and 148, it is necessary that the differences Dwur-Dwlb between the values of all the amplified six white reference color component signals Swur'-Swlb' and the corresponding reference level voltage values Eur-Elb fall within a predetermined high level range Vhigh ±ΔV which is also stored in the ROM 165. If the all the differences Dwur-Dwlb fall within the predetermined high level range, white level is properly adjusted in the sewing machine.

In the case where both the black and white levels are properly adjusted, dynamic range is also properly adjusted, since the dynamic range is defined as a difference between the black and white levels. Furthermore, as in the first embodiment, since the white level is properly adjusted, the white balance of the sewing machine is also properly adjusted.

Since the white and black levels are defined as described above, the process for automatically adjusting the white and the black levels are performed, as follows.

As described above, the black level is properly adjusted, in the case where the differences between the values of all the six black reference color component signals Sbur-Sblb and the corresponding reference voltages Eur-Elb fall within the predetermined low level range Vlow±ΔV. Since the reference voltages Eur--Elb are determined dependently on the reference voltage signals D227-D232 which are produced from the CPU 163 responsive to the reference data Rur-Rlb stored in the RAM 168, the black level adjustment is attained through updating the reference voltage signals D227-D232 and the reference data Rur-Rlb stored in the RAM 168.

On the other hand, the white level is properly adjusted, in the case where the differences Dwur-Dwlb between the values of all the six white reference color component signals Swur'-Swlb' amplified with the amplification factors and the corresponding reference level voltages Eur-Elb fall within the predetermined high level range Vhigh±ΔV. Since the amplification factors Fur-Flb are determined dependenly on the amplifier control signals D221 -D226 which are produced from the CPU 163 responsive to the amplification data Aur-Alb stored in the RAM 168, the white level adjustment is attained through updating the amplifier control signals D221-D226 and the amplification data Aur-Alb stored in the RAM 168. It should be noted that the white level adjustment is attained with the use of the reference data Rur-Rlb and the reference volgage signals D227-D232 (the reference level voltages Eur-Elb) which have been updated through the black level adjustment.

Figure 20:
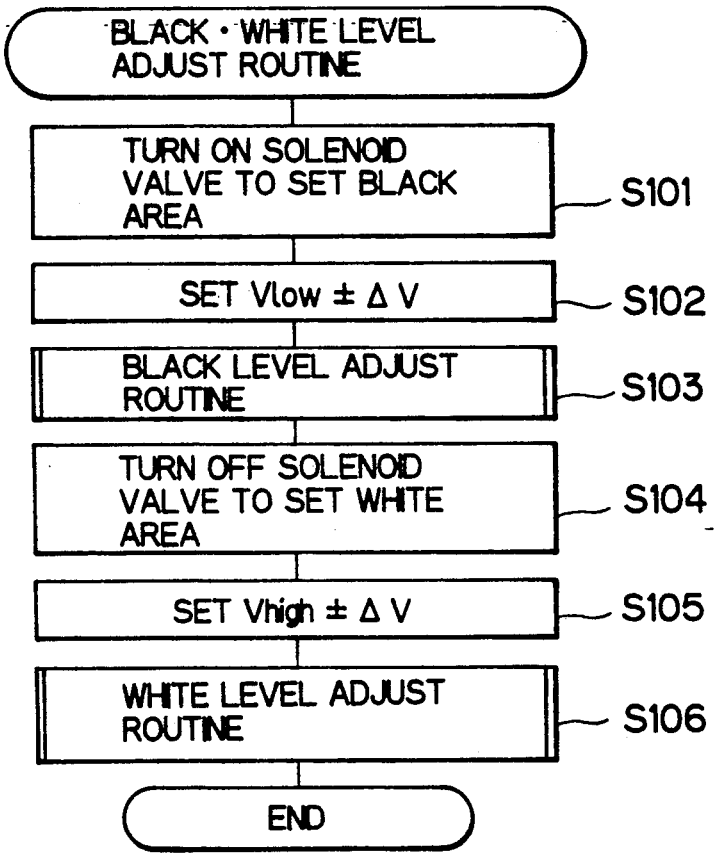
FIG. 20 is a flowchart of an automatic black-white level adjustment routine of the third embodiment.

According to the embodiment, immediately after the power supply of the pattern matching sewing machine 1 is turned on, the automatic white balance adjusting routine shown in FIG. 20 is started to be conducted, since the automatic adjustment switch 240 is not employed in the present embodiment and the guide plates 303, 104 and 305 are closed to be tightly contacted with one another at the timing when the power supply of the sewging machine is turned on.

As shown in FIG. 20, when the white and black level adjusting process is started with no fabric being inserted between the guide plates, the CPU 163 first turns on the solenoid valve 331 to allow the black color areas 311 of the color reference boards 315 to confront the prisms 105 and 106 of the detecting unit 113, in a step S101. Then, the CPU 163 reads out the low level range Vlow$\pm\Delta$V from the ROM 165 and sets it into the RAM 168, in a step S102. Then, the automatic black level adjusting routine shown in FIG. 21 is executed in a step S103 as a subroutine.

Figure 22:
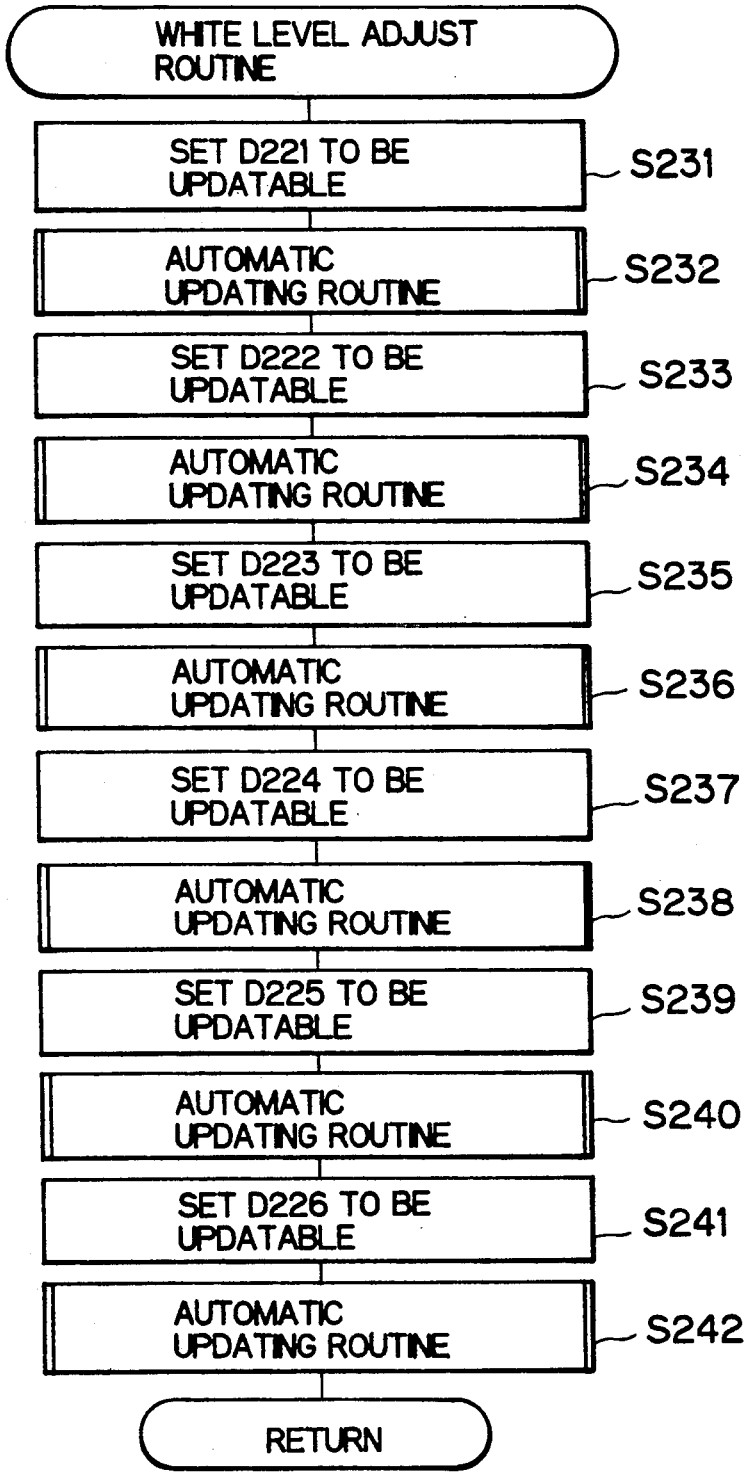
FIG. 22 is a flowchart of an automatic white level adjustment routine in the black-white level adjustment routine of the third and fourth embodiments.

When the automatic black level adjusting routine is completed, the CPU 163 turns on the solenoid valve 331 to allow the white color area 312 of the color reference boards 315 to confront the prisms 105 and 106 of the detecting unit 113, in a step S104. Then, the CPU 163 reads out the high level range Vhigh$\pm\Delta$V from the ROM 165 and sets it into the RAM 168, in a step S105. Then, the automatic white level adjusting routine shown in FIG. 22 is executed in a step S106 as a subroutine.

Figure 21:
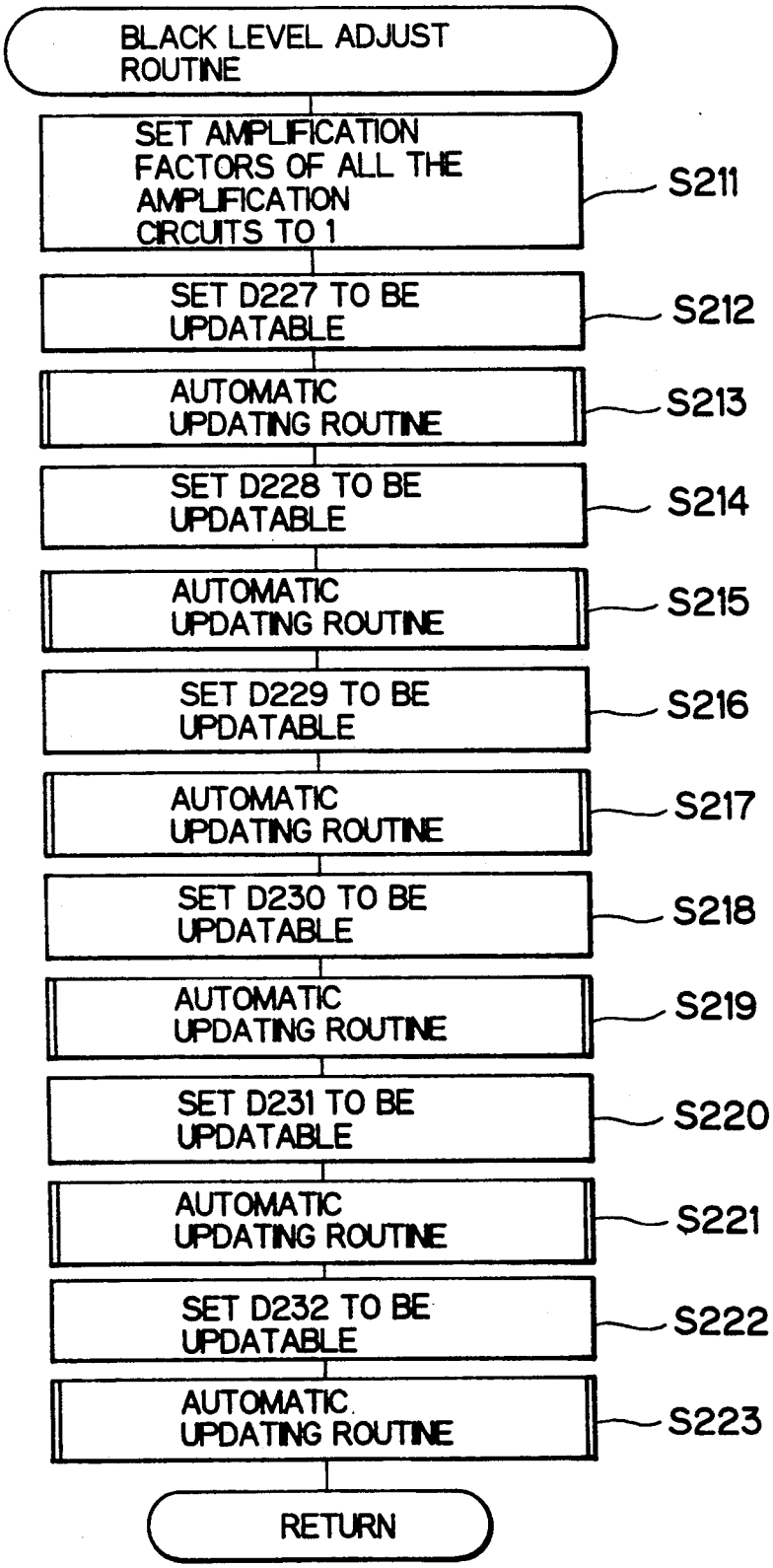
FIG. 21 is a flowchart of an automatic black level adjustment routine in the black-white level adjustment routine of the third embodiment.
Figure 23:
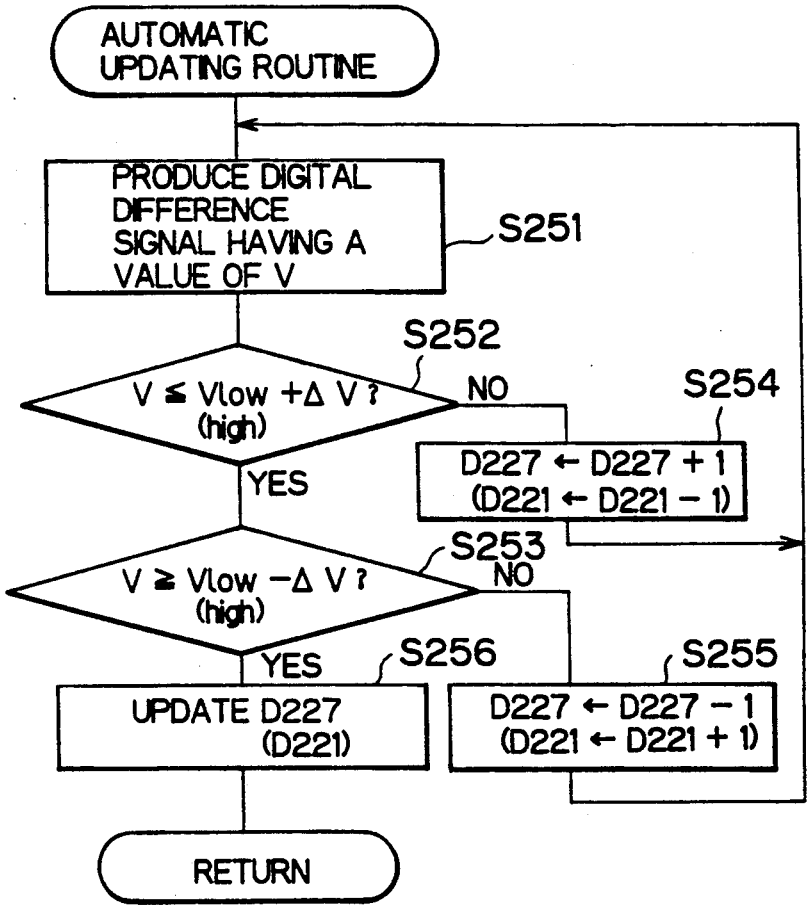
FIG. 23 is an updating routine in the automatic adjustment routine of the third and fourth embodiments.

In the automatic black level adjusting routine, as shown in FIG. 21, in step S211, the CPU 163 temporarily changes the values of all the amplifier control signals D221 -D226 to change the amplification factors Fur-Flb of all the amplifier circuits 201-206 into 1, irrespective of the values of the amplification data Aur-Alb stored in the RAM 168. In other words, the CPU 63 sets all the amplification factors Fur-Flb to 1 for the black level adjustment process. (It should be noted that the compulsory setting of the control signals D221-D226 is only effected during the black level adjustment routine but is not effected during the white level adjustment routine which will be described later.) Then, in steps S212, S214, S216, S218, S220 and S222, the CPU 163 changes the reference voltage signals D227 through D232 into such a condition as being updatable. That is, the CPU 163 changes the RAM 168 into such a state that the reference data Rur-Rlb stored therein can be updated. Then, in each of steps S213, S215, S217, S219, S221 and S223, the automatic updating routine shown in FIG. 23 is conducted, as subroutine of the automatic black level adjustment routine.

The updating routine will be described below with reference to FIG. 23. In FIG. 23, only the routine for updating the reference voltage signal D227 is shown by way of example.

In this routine, in a step S251, the black reference red color component signal Sbur for the upper reference board 315 is amplified in the amplifier circuit 201 with the amplification factor of 1. Then, the differential amplifier circuit 207 outputs the difference signal Dbur having a difference value between the black reference red color component Sbur and the reference level voltage Eur determined in accordance with the reference voltage signal D227. Thus obtained difference signal Dbur is converted into digital signal Dbur' in the A/D converter 170. Thus obtained digital difference signal Dbur' has a digital voltage value of V. Then, steps S252 and S253 judge whether the digital voltage value V falls in the predetermined low level range Vlow$\pm\Delta$V now stored in the RAM 168.

When the digital voltage value V is judged to be higher than the upper limit level Vlow$+\Delta$V of the low level range Vlow$\pm\Delta$V in the step S252, then a value 1 is added to the value of the reference voltage signal D227, in step S254. Thereafter, the step S251 is executed again. Since the value of the signal D227 determines the value of the reference level voltage Eur, the digital value V obtained in the step S251 at this time becomes smaller than the value V obtained in the previously conducted step S251. The step S252 determines again whehter or not thus reduced difital voltage V is equal to or less than the upper limit Vlow$+\Delta$V. The steps S251, S252 and S254 are repeated until when the voltage value V becomes equal to or lower than the upper level Vlow $+\Delta$V. When the digital voltage value V is judged to be lower than the lower limit level Vlow$-\Delta$V of the low level range Vlow$\pm\Delta$V in step S253, then a value 1 is subtracted from the value of the reference voltage signal D227, in step S255. The steps S251, S253 and S255 are repeated until when the voltage value V becomes equal to or higher than the lower limit level Vlow$-\Delta$V. Then, in step S256, the reference level data Rur stored in the RAM 168 is updated to have such a value that the reference voltage signal D227 to be produced dependently on the data Rur may be updated to have the value newly obtained through the steps S254 and S255. As a result, the data Rur is selected to have such a value as attaining a proper black level for the difference signal Dur' to be obtained from the upper fabric.

Through the steps S215, S217, S219, S221 and S223 of the black level adjust routine, the same updating routine is further conducted for the green and blue color component signals Dbug' and Dbub' obtained from the upper board and the red, green and blue color component signals Dblr', Dblg' and Dblb' obtained from the lower board. Thus, a proper black level is attained for all the signals Dur'-Dlb' to be obtained from the upper and lower fabrics. In other words, all the reference level data Rur-Rlb are selected to have such values as attaining proper black levels for all the signals Dur'-Dlb' indicative of the color state of the upper and lower fabrics.

In the automatic white level adjusting routine, as shown in FIG. 22, in steps S231, S233, S235, S237, S239 and S241, the CPU 163 changes the amplifier control signals D221 through D226 into such a condition as being updatable. That is, the CPU 163 changes the RAM 168 into such a state that the amplification data Aur-Alb stored therein can be updated. Then, in each of steps S232, S234, S236, S238, S240 and S242, the automatic updating routine shown in FIG. 23 is conducted for updating the amplifier control signals D221 through D226.

The updating routine is almost the same as the updating routine which is conducted in the black level adjustment routine as shown in FIG. 23.

In other words, in the updating routine, in a step S251, the white reference red color component signal Swur for the upper reference board 315 is amplified in the amplifier circuit 201 with the amplification factor Fur determined dependently on the amplifier control signal D221. Then, the differential amplifier circuit 207 outputs the difference signal Dur having a difference value between the amplified white reference red color component Swur' and the reference level voltage Eur which has been obtained through the already conducted black level adjustment process. Thus obtained difference signal Dur is converted into digital form Dur' in the A/D converter 170. Thus obtained digital difference signal Dur' has a digital voltage value of V. Then, steps S252 and S253 judge whether the digital voltage value V falls in the predetermined high level range Vhigh±ΔV now stored in the RAM 168.

When the digital voltage value V is judged to be higher than the upper limit level Vhigh+ΔV of the high level range Vhigh±ΔV in the step S252, then a value 1 is subtracted from the value of the amplifier control signal D221, in step S254. The steps S251, S252 and S254 are repeated until when the voltage value V becomes equal to or lower than the upper level Vhigh+ΔV. When the digital voltage value V is judged to be lower than the lower limit level Vhigh−ΔV of the high level range Vlow±ΔV in step S253, then a value 1 is added to the value of the amplifier control signal D221, in step S255. The steps S251, S253 and S255 are repeated until when the voltage value V becomes equal to or higher than the lower limit level Vhigh−ΔV. Then, in step S256, the amplification data Aur stored in the RAM 168 is updated to have such a value that the amplifier control signal D221 to be obtained dependently on the data Aur may be updated to have the value newly obtained through the steps S254 and S255. As a result, the data Aur is selected to have such a value as attaining a proper white level for the difference signal Dur' to be obtained from the upper fabric.

Through the steps S234, S236, S238, S240 and S242 of the white level adjust routine, the same updating routine is further conducted for the green and blue color component signals Dwug' and Dwub' obtained for the upper board and the red, green and blue color component signals Dwlr', Dwlg' and Dwlb' obtained for the lower board. Thus, a proper white level is attained for all the signals Dur'-Dlb' to be obtained for the upper and lower fabrics.

Since the dynamic range is defined as a difference between the white level and the black level, according to the present embodiment, the dynamic range having the predetermined value of Vhigh−Vlow±2ΔV is properly attained for all the signals Dur'-Dlb' indicative of the color state of the upper and lower fabrics. Therefore, according to the black - white level adjustment process described above, the dynamic range is adjusted for the sewing machine 1. In addition, through the white level adjustment process, the white balance can also be adjusted. Furthermore, in the present embodiment, since the color reference boards 315 are provided in the guide plates as in the second embodiment, the operator may simply turn on the power switch of the sewing machine so as to conduct the white and black level adjustment operation.

According to the embodiment, since the proper dynamic range and the proper white balance can be automatically attained, the shift (mismatch) amount of the patterns of the upper and lower fabrics can be calculated accurately and the pattern matching operation can be properly conducted.

A fourth embodiment of the present invention will be described below, with reference to FIGS. 24 through 26. A pattern matching sewing machine of the present embodiment is almost the same as that of the third embodiment, both in its structure and in its function. The sewing machine 1 of the present embodiment differs from that of the third embodiment, in the structure of the color reference boards and in that the sewing machine of the present embodiment conducts only the white balance adjustment as in the first embodiment.

Figure 24:
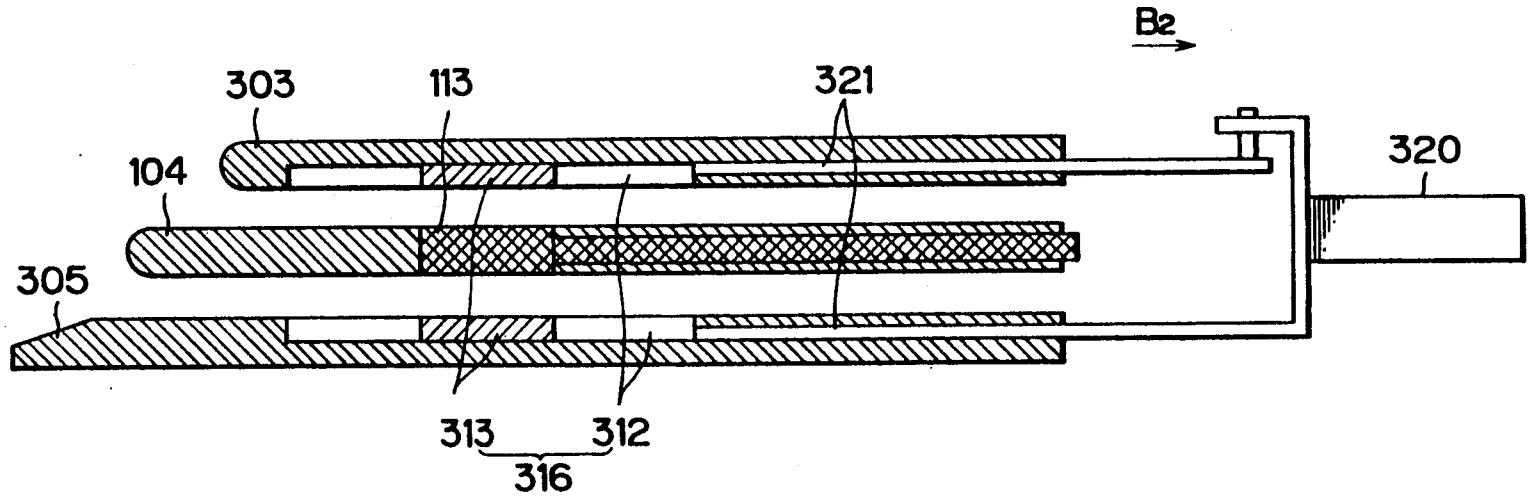
FIG. 24 is a cross-sectional view of fabric guide plates of the fourth embodiment with the refleciton color areas confronting the detector unit.
Figure 25:
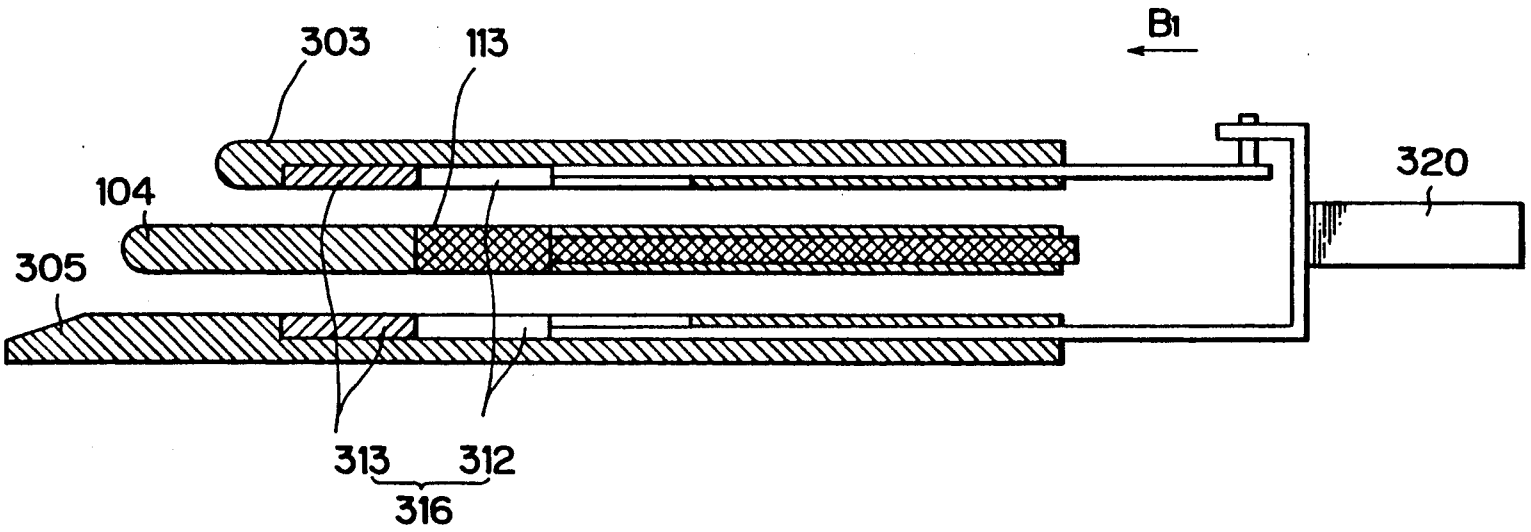
FIG. 25 is a cross-sectional view of fabric guide plates of the fourth embodiment with the white color areas confronting the detector unit.

As shown in FIG. 24, in the present embodiment, each reference color board 316 has a reflection area 313, instead of the black color area 311 of the third embodiment. Therefore, each reference color board 316 has the white color area 312 and the reflection area 313 arranged along the directions B1 and B2 in FIG. 24. The reflection area 313 is coated with reflection material with its reflection coefficient being much higher than that of the white color. The light beam reflected by the reflection area 313 will have such a lightness value as being much higher than that reflected by any of the fabrics 87 and 88 and the white color area 312. Therefore, the reflection area 313 of the reflection color board 316 provided in the upper guide plate 303 serves as means for detecting whether or not the upper fabric 87 is inserted between the upper and middle guide plates 303 and 104. The reflection area 313 of the reflection color board 316 provided in the lower guide plate 305 serves as means for detecting whether or not the lower fabric 88 is inserted between the middle and lower guide plates 104 and 305.

In the present embodiment, the solenoid valve 331 is usually turned off, as shown in FIG. 24 so that the reflection areas 313 are positioned to confront the prisms 115 and 116 of the detector 113 in the middle guide plate 304. In the present embodiment, a program of the automatic white balance adjustment routine shown in FIG. 26 is stored in the ROM 165. The white balance adjustment routine shown in FIG. 26 is started immediately after when the power supply of the sewing machine is switched on.

Figure 26:
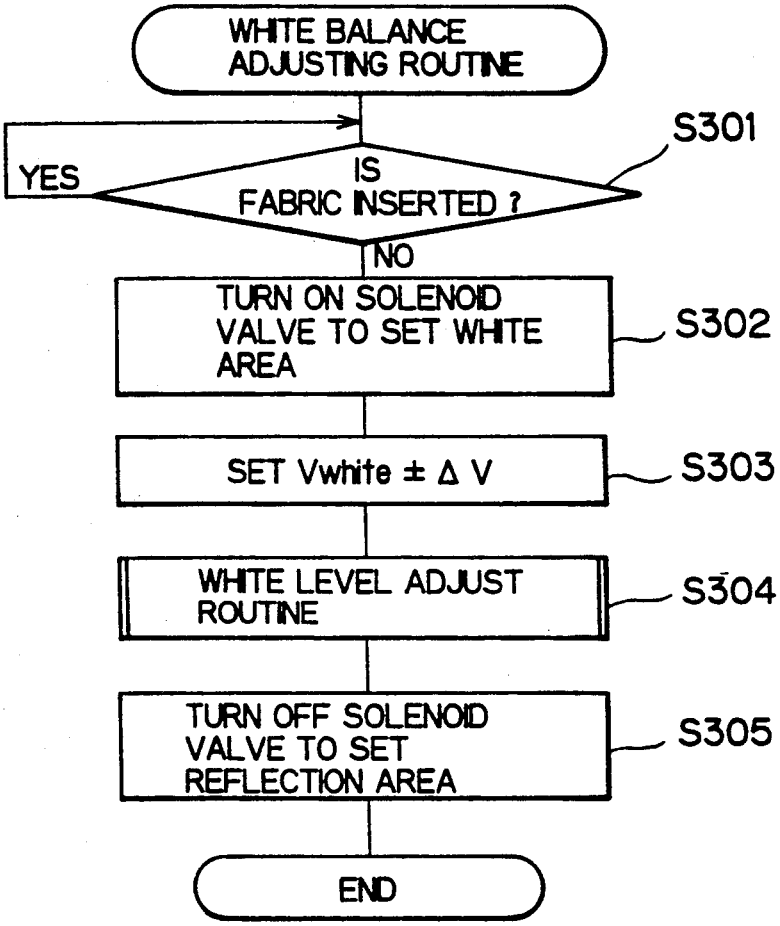
FIG. 26 is a flowchart of an automatic white balance adjustment routine of the fourth embodiment.

In the white balance adjustment routine, as shown in FIG. 26, the CPU 163 first detects, by the reflection areas 313 confronting the prisms 115 and 116, whether or not upper fabric 87 or lower fabric 88 is inserted between the fabric guide plates, in step S301. Then, if any of the upper and lower fabrics 87 and 88 is inserted between the guide plates, the CPU 163 turns on the solenoid valve 331 through the driver circuit 330 so as to allow the white color areas 312 of the reference color boards 316 to confront the prisms 115 and 116, in step S302, as shown in FIG. 25. Then, in step S303, the CPU 163 reads out the information of the high level range Vhigh±ΔV and sets it into the RAM 168. Then, the white level adjustment routine shown in FIGS. 22 and 23 is conducted in a step S204, as a subroutine. When the white level adjustment routine is completed, the solenoid valve 331 is turned off to allow the reflection areas 313 of the reference color boards 316 to confront the prisms 115 and 116.

In the third and fourth embodiments, the black and white level adjustment and the white level adjustment are started to be conducted immediately after when the power supply of the sewing machine is turned on. However, the adjustments may be initiated upon completion of a thread cutting operation. Furthermore, as in the first and second embodiments, the automatic adjustment switch 240 may be provided in the sewing machine.

As described above in detail, the device for processing a sheet material with a pattern according to the present invention simply and reliably effects a color state adjustment process. As a result, an information on the pattern can be obtained accurately and the sheet material processing operation can be properly conducted.

Since the color state adjustment is conducted automatically, the time required for the adjustment process can greatly be reduced. Furthermore, the color state adjustment process requires no skill, and can simply and reliably be effected on the device after it has been shipped, by the user when necessary.

The number of components used in the processing machine is reduced, and any erroneous action which would otherwise tend to occur with the switches of variable resistors after the color state adjustment process.

While the embodiments of the present invention have been described above, the present invention is not limited to the illustrated embodiments, but various changes and modifications may be made therein without departing from the scope of the invention.

In the first, third and fourth embodiments, the color balance adjustment is effected with respect to white color. However, the balance of color component signals may be adjusted using yellow as a reference color. That is, a red color component signal level with respect to yellow color should be in a certain red signal level range, a green color component signal level should be in a certain green signal level range, and a blue signal level should be in a certain blue signal level range. Accordingly, optical reference information may be represented by white, yellow, or any of other colors, provided level adjustment ranges with respect to signals of red, green, and blue are different unlike the white balance adjustment process.

In the third embodiment, the dynamic range adjustment is carried out with respect to the white and black colors, and therefore the each color reference board 315 has the black and white color areas 311 and 312. This is because the color sensors 144 and 148 employed in the sewing machine serve to detect the three primary color components of the fabric patterns, and therefore the highest level obtainable by the color sensors corresponds to white color and the lowest level obtainable by the color sensors corresponds to black color.

However, the each color reference board 315 may employ other color areas. For example, in the case where the color sensor having only a red color filter is employed in the sewing machine, the dynamic range is determined according to the red and black color, and therefore the each color reference board 315 may be provided with red and black color areas.

Instead of the black color area, dark blue area may be employed in the reference color board. Instead of the white color area, a reflection area having a recurrence property may be employed. As apparent from the above, kinds of the colors of the reference board may be selected in accordance with the kinds of the color sensors and the manner how the dynamic range is defined.

Furthermore, the third and fourth embodiments may be combined with each other so that the reference color board may be provided with three color areas, i.e., the white color area, the black color area and the reflection color area. As a result, the sewing machine can conduct both the black-white level adjustment and the detection whether or not the fabrics are placed between the fabric guide plates. Through conducting the detection of the state of the fabric before conducting the white-black level adjustment, it becomes possible to conduct the white-black level adjustment at any time. For example, it becomes possible to conduct the white-black level adjustment, with a predetermined time interval. In the case where the processing machine is placed in such a place where the atmospheric temperature is largely changed or in the case where the processing machine is required to conduct a high precision processing operation, it is preferable that the white-black level adjustment be conducted with the predetermined time interval.

The present invention may be applied not only to the pattern matching sewing machine, but also to various processing devices which sort out a sheet material by detecting a colored pattern thereof, or determine the direction of a sheet material based on its pattern and control a transfer means for transferring the sheet material to another processing device in a predetermined direction.

The present invention may be applied to such an apparatus as detecting patterns through discriminating only between black color and white color or through detecting lightness of the patterns.

We claim:

1. A processing device for processing sheet material with a pattern, comprising:

detecting means for detecting a color state of the pattern of the sheet material and producing a color state signal indicative of the color state;

adjusting means for adjusting said detecting means to allow said detecting means to produce a desired color state signal with respect to a reference color state, said adjusting means including detection control means for controlling said detecting means to detect the reference color state to produce a color state signal indicative of the detected reference color state, said adjusting means adjusting said detecting means, in response to the produced color state signal, to thereby allow said detecting means to produce the desired color state signal with respect to the reference color state; and processing means for processing the sheet material on the basis of the color state signal produced by said detecting means.

2. The processing device as claimed in claim 1, wherein said detecting means includes:

color detecting means for detecting the color state of the sheet material pattern and producing a color signal corresponding to the color state; and conversion means for converting, with a conversion manner, the color signal into the color state signal indicative of the color state of the sheet material pattern;

and wherein said adjusting means adjusts the conversion manner of the conversion means to allow the conversion means to produce the desired color state signal with respect to the reference color state.

3. The processing device as claimed in claim 2, wherein said adjusting means includes:

control means for controlling the color detecting means to detect the reference color state and produce a reference color signal; and conversion manner adjusting means for adjusting, in response to the produced reference color signal, the conversion manner of the conversion means to allow the conversion means to produce the desired color state signal with respect to the reference color state.

4. The processing device as claimed in claim 3, wherein said adjusting means includes:

control means for controlling the color detecting means to detect the reference color state and produce a reference color signal and for controlling said conversion means to convert the reference color signal into a reference color state signal indicative of the reference color state; and conversion manner adjusting means for adjusting, in response to the produced referenced color state signal, the conversion manner of the conversion means to allow the reference color state signal to have a value within a value range indicative of the desired color state signal.

5. The processing device as claimed in claim 4, wherein the conversion means includes:

conversion signal producing means for producing a conversion signal indicative of the conversion manner; and conversion conducting means for converting the color signal into the color state signal in response to the conversion signal, and wherein the conversion manner adjusting means controls the conversion signal producing means to adjust the conversion signal.

6. The processing device as claimed in claim 5, wherein the control means includes selecting means for controlling the color detecting means to selectively detect the color state of the sheet material pattern and the reference color state.

7. The processing device as claimed in claim 6, wherein the control means further includes reference color state providing means for allowing the color detecting means to detect the reference color state.

8. The processing device as claimed in claim 6, wherein the conversion signal producing means produces the conversion signal representing an amplification ratio, and the conversion conducting means amplifies a value represented by the color signal with the amplification ratio to produce the color state signal, and wherein the conversion manner adjusting means adjusts the conversion signal to thereby adjust the amplification ratio.

9. The processing device as claimed in claim 8, wherein the conversion signal producing means produces the conversion signal representing a standard level, and the conversion conducting means obtains a difference between the standard level and a value represented by the color signal to produce the color state signal, and wherein the conversion manner adjusting means adjusts the conversion signal to thereby adjust the standard level.

10. The processing device as claimed in claim 4, wherein the color signal produced by the color detecting means includes color component signals indicative of red, green and blue primary color components of the color state.

11. The processing device as claimed in claim 10, wherein the control means controls the color detecting means to detect white color state and produce white color component signals corresponding to red, green and blue color components of the white color state, and wherein the conversion means converts the white color component signals into white state color component signals indicative of the red, green and blue color components of the white color state.

12. The processing device as claimed in claim 11, wherein the conversion manner adjusting means adjusts the conversion manner of the conversion means so that all the white state color component signals may have values within a predetermined value range.

13. The processing device as claimed in claim 11, wherein the control means controls the color detecting means to detect black color state and produce black color component signals corresponding to red, green and blue color components of the black color state, and wherein the conversion means converts the black color component signals into black state color component signals indicative of the red, green and blue color components of the black color state.

14. The processing device as claimed in claim 13, wherein the conversion manner adjusting means adjusts the conversion manner of the conversion means so that all the differences between the white state color component signals and the corresponding black state color component signals may have values within a predetermined value range.

15. A sewing machine for sewing two sheet materials having patterns, comprising;

detecting means for detecting color states of the patterns of the sheet materials and producing color state signals indicative of the color states;

adjusting means for adjusting said detecting means to allow said detecting means to produce a desired color state signal with respect to a reference color state, said adjusting means including detection control means for controlling said detecting means to detect the reference color state to produce a color state signal indicative of the detected reference color state, said adjusting means adjusting said detecting means, in response to the produced color state signal, to thereby allow said detecting means to produce the desired color state signal with respect to the reference color state; and sewing means for feeding the sheet materials on the basis of the color state signals produced by said detecting means and joining the sheet materials.

16. The sewing machine as claimed in claim 15, wherein said detecting means includes:

color detecting means for detecting the color states of the sheet material patterns and producing color signals corresponding to the color states; and conversion means for converting, with a conversion manner, the color signals into the color state signals indicative of the color states of the sheet material patterns;

and wherein said adjusting means adjusts the conversion manner of the conversion means to allow the conversion means to produce the desired color state signal with respect to the reference color state.

17. The sewing machine as claimed in claim 16, wherein said adjusting means includes:

control means for controlling the color detecting means to detect the reference color state and produce a reference color signal; and conversion manner adjusting means for adjusting, in response to the produced reference color signal, the conversion manner of the conversion means to allow the conversion means to produce the desired color state signal with respect to the reference color state.

18. The processing device as claimed in claim 17, wherein said adjusting means includes:

control means for controlling the color detecting means to detect the reference color state and produces a reference color signal and for controlling said conversion means to convert the reference color signal into a reference color state signal indicative of the reference color state; and conversion manner adjusting means for adjusting, in response to the produced reference color state signal, the conversion manner of the conversion means to allow the reference color state signal to have a value within a value range indicative of the desired color state signal.

19. The processing device as claimed in claim 4, wherein said conversion manner adjusting means adjusts, in response to the produced reference color state signal, the conversion manner of the conversion means to allow the reference color state signal to have a value equal to that of the desired color state signal.

20. The processing device as claimed in claim 12, wherein the conversion manner adjusting means adjusts the conversion manner of the conversion means so that all the white state color component signals have a predetermined value.

21. The processing device as claimed in claim 14, wherein the conversion manner adjusting means adjusts the conversion manner of the conversion means so that all the differences between the white state color component signals and the corresponding black state color component signals have a predetermined value.

22. The processing device as claimed in claim 18, wherein said conversion manner adjusting means adjusts, in response to the produced reference color state signal, the conversion manner of the conversion means to allow the reference color state signal to have a value equal to that of the desired color state signal.

* * * * *